US008687985B2

(12) United States Patent
Kiryu

(10) Patent No.: US 8,687,985 B2
(45) Date of Patent: Apr. 1, 2014

(54) BELT DRIVE APPARATUS FOR CORRECTING BELT POSITION IN DIRECTION OF WIDTH

(75) Inventor: Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 311 days.

(21) Appl. No.: 13/048,417

(22) Filed: Mar. 15, 2011

(65) Prior Publication Data

US 2011/0229159 A1 Sep. 22, 2011

(30) Foreign Application Priority Data

Mar. 18, 2010 (JP) ..... 2010-063198
Feb. 17, 2011 (JP) ..... 2011-032015

(51) Int. Cl.
*G03G 15/02* (2006.01)
*G03G 15/01* (2006.01)
*G03G 15/20* (2006.01)

(52) U.S. Cl.
USPC ..... 399/31; 399/302; 399/313

(58) Field of Classification Search
USPC ..... 399/31, 66, 302, 303, 308, 313
See application file for complete search history.

(56) References Cited

U.S. PATENT DOCUMENTS 5,096,044 A * 3/1992 Biebel ..... 198/502.4
7,228,095 B2 * 6/2007 Kuroda ..... 399/302
7,778,574 B2 * 8/2010 Itagaki ..... 399/302 X
2008/0213009 A1 * 9/2008 Kamoshita et al. ..... 399/313

FOREIGN PATENT DOCUMENTS

JP 11-024507 1/1999
JP 2004-271718 9/2004

* cited by examiner

*Primary Examiner* — Sandra Brase
(74) *Attorney, Agent, or Firm* — IPUSA, PLLC

(57) ABSTRACT

A belt drive apparatus is equipped with an endless belt rotationally movable by being supported by a plurality of rollers. A moving speed signal output part outputs a signal based on a rotational movement of the endless belt. A width direction position signal output part outputs a position signal for which its value changes in response to a position of the endless belt in a direction of width of the endless belt. A width direction position control part controls a position of the endless belt in the direction of width of the endless belt. A process execution part performs a predetermined process using the signal output from the moving speed output part based on the position signal output from the width direction position signal output part.

9 Claims, 19 Drawing Sheets

FIG.8A
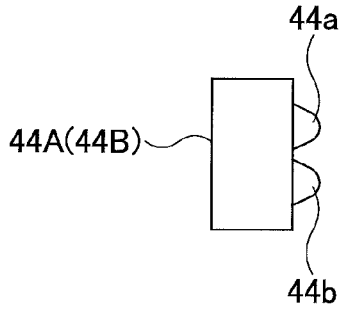
FIG.8B
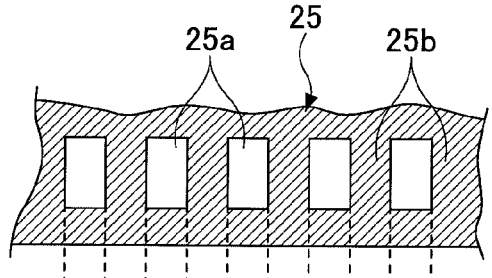
FIG.8C
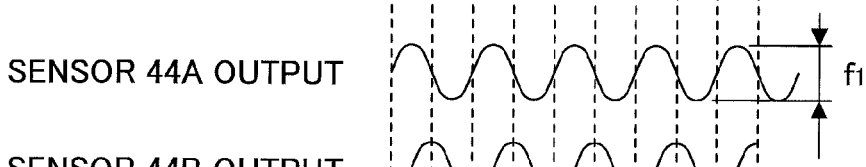
FIG.8D
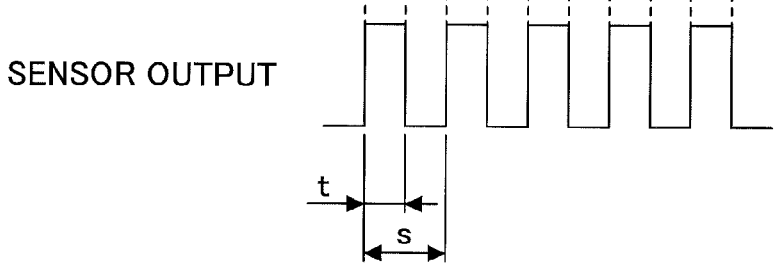
FIG.8E

BELT DRIVE APPARATUS FOR CORRECTING BELT POSITION IN DIRECTION OF WIDTH

BACKGROUND OF THE INVENTION

1. Field of the Invention

The present invention relates to a belt drive apparatus and a belt drive method for correcting a position of a belt in a direction of a width of the belt.

2. Description of the Related Art

In an image forming apparatus using an intermediate transfer belt to convey a print paper, there may be a case where the intermediate transfer belt is shifted (displaced) in a direction of a width (hereinafter, a width direction) of the intermediate transfer belt while driving the intermediate transfer belt to travel. In such a case, the intermediate transfer belt travels while meandering. As a method of correcting a position of the intermediate transfer belt in the width direction by eliminating a shift or displacement, Japanese Laid-Open Patent Application No. 2004-271718 (hereinafter, Patent Document 1) suggests a method of controlling meandering of an intermediate transfer belt by inclining a roller supporting the intermediate transfer belt.

The Patent Document 1 also suggests providing an edge sensor, which detects a position of an edge of the belt, to detect an amount of meandering (a position in the width direction, hereinafter, a meandering amount) of the belt based on the detected position of the belt edge, and controlling an inclination of a roller for inclining (hereinafter, a steering roller) to maintain the meandering amount constant.

Moreover, the Patent Document 1 discloses, as a method of driving an intermediate transfer belt, a method of controlling a speed of the intermediate transfer belt based on a belt scale interval by detecting a plurality of lines of the belt scale provided on the intermediate transfer belt by a scale sensor. Hereinafter, this control is referred to as an intermediate transfer belt feedback control.

Further, the Patent Document 1 discloses a method of notifying, if an abnormality occurs in the belt scale or the scale sensor, of the abnormality in the belt scale or the scale sensor.

When performing both the above-mentioned belt width direction position control according to the steering method and the above-mentioned feed control of the intermediate transfer belt, the belt scale is arranged on only a part of the intermediate transfer belt (for example, a part along one side of the intermediate transfer belt in the width direction).

Moreover, at a time of replacing an intermediate transfer belt, there may be a case where the intermediate transfer belt is attached at a position apart from a reference position. FIG. 1 illustrates a state where the intermediate transfer belt 1 is displaced far away from the reference position. When the intermediate transfer belt 1 is displaced far away from the reference position, there may be a case where a scale sensor 44 cannot detect a belt scale 25 provided on the intermediate transfer belt 1.

FIG. 2 is a flowchart of a process according to a method of notifying of an abnormality in the belt scale 25 and the scale sensor 44. First, a drive operation of a drive motor for driving the intermediate transfer belt 1 is started to rotate the intermediate transfer belt 1 (step S2). Then, a CPU as a control part acquires an output signal of the scale sensor 44 immediately after the start of the drive operation of the drive motor. Thereafter, the CPU judges whether the output signal of the scale sensor 44 was changed within a fixed time (step S4). Here, the change in the output signal of the scale sensor 44 indicates that the scale sensor 44 is normally detecting (or reading) the belt scale 25.

If the CPU judges that the output signal of the scale sensor 44 was changed, that is, if the scale sensor 44 normally detected the belt scale 25 (YES of step S4), the CPU ends the process. On the other hand, if the CPU judges that the value (amplitude) of the output signal of the scale sensor 44 was not changed, that is, the scale sensor 44 did not normally detect the belt scale 25 (NO of step S4), a notification is sent that the belt scale 25 of the intermediate transfer belt 1 or the scale sensor 44 has an abnormality (step S6).

However, if the intermediate transfer belt 1 is displaced far away from the reference position as illustrated in FIG. 1, the scale sensor 44 cannot detect the belt scale 25. Accordingly, there may be a problem in that although there are no abnormalities in the scale sensor 44 and the belt scale 25, an abnormality of the scale sensor 44 or the belt scale 25 is notified because the scale sensor 44 cannot detect the belt scale 25.

SUMMARY OF THE INVENTION

It is a general object of the present invention to provide an improved and useful belt drive apparatus in which the above-mentioned problems are eliminated.

A more specific object of the present invention is to provide a belt drive apparatus and a belt drive method, which can perform an accurate process (for example, the feedback process of an intermediate transfer belt) when there are no abnormalities in a belt scale of the intermediate transfer belt or a scale sensor.

In order to achieve the object, there is provided according to one aspect of the present invention a belt drive apparatus, including: an endless belt rotationally movable by being supported by a plurality of rollers; a moving speed signal output part configured to output a signal based on a rotational movement of the endless belt; a width direction position signal output part configured to output a position signal for which its value changes in response to a position of the endless belt in a direction of width of the endless belt; a width direction position control part configured to control a position of the endless belt in the direction of width of the endless belt; and a process execution part configured to perform a predetermined process using the signal output from the moving speed output part based on the position signal output from the width direction position signal output part.

Additionally, there is provided according to another aspect of the present invention an image forming apparatus, including: the above-mentioned belt drive apparatus; and an image forming part configured to form a visible image on the endless belt of the belt drive apparatus.

Further, there is provided according to a further aspect of the present invention a belt drive method, including: outputting a signal based on a rotational movement of an endless belt, which rotationally moves while being supported by a plurality of rollers; outputting a position signal for which its value changes in response to a position of the endless belt in a direction of width of the endless belt; controlling the position of the endless belt in the direction of width of the endless belt; and performing a predetermined process using the signal based on a rotational movement of the endless belt based on the position signal.

According to the present invention, when there are no abnormalities in a mechanism for detecting a rotational movement of the endless belt (for example, a belt scale and a scale sensor), an appropriate process (for example, a feedback process of the rotational movement of the endless belt) can be surely performed.

Other objects, features and advantages of the present invention will become more apparent from the following detailed description when read in conjunction with the accompanying drawings.

BRIEF DESCRIPTION OF THE DRAWINGS

FIGS. 8A through 8E are illustrations for explaining a scale sensor and output signals of the scale sensor;

DETAILED DESCRIPTION OF THE PREFERRED EMBODIMENTS

Figure 1:
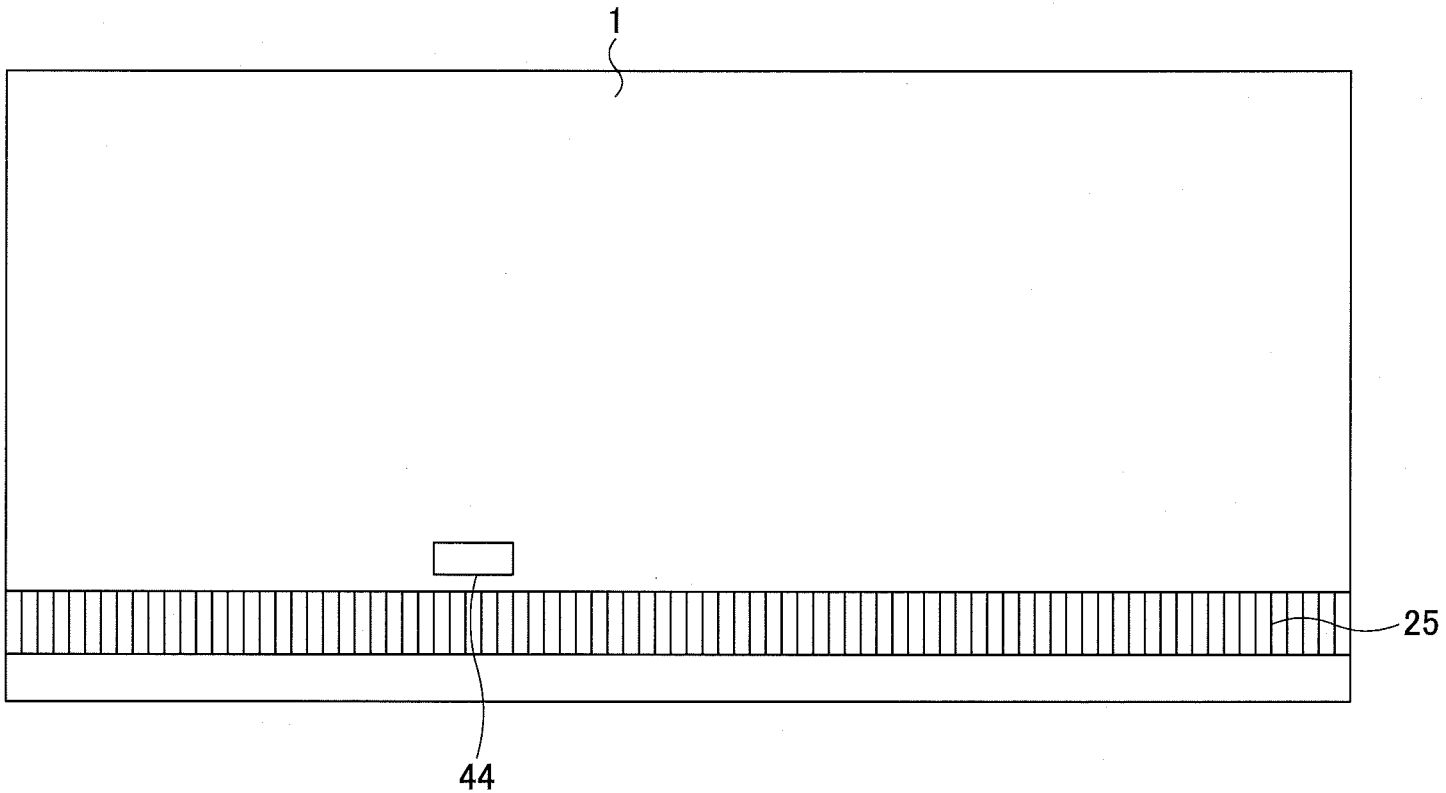
FIG. 1 is a plan view of an intermediate transfer belt in a state where an intermediate transfer belt is displaced far away from a reference position.
Figure 2:
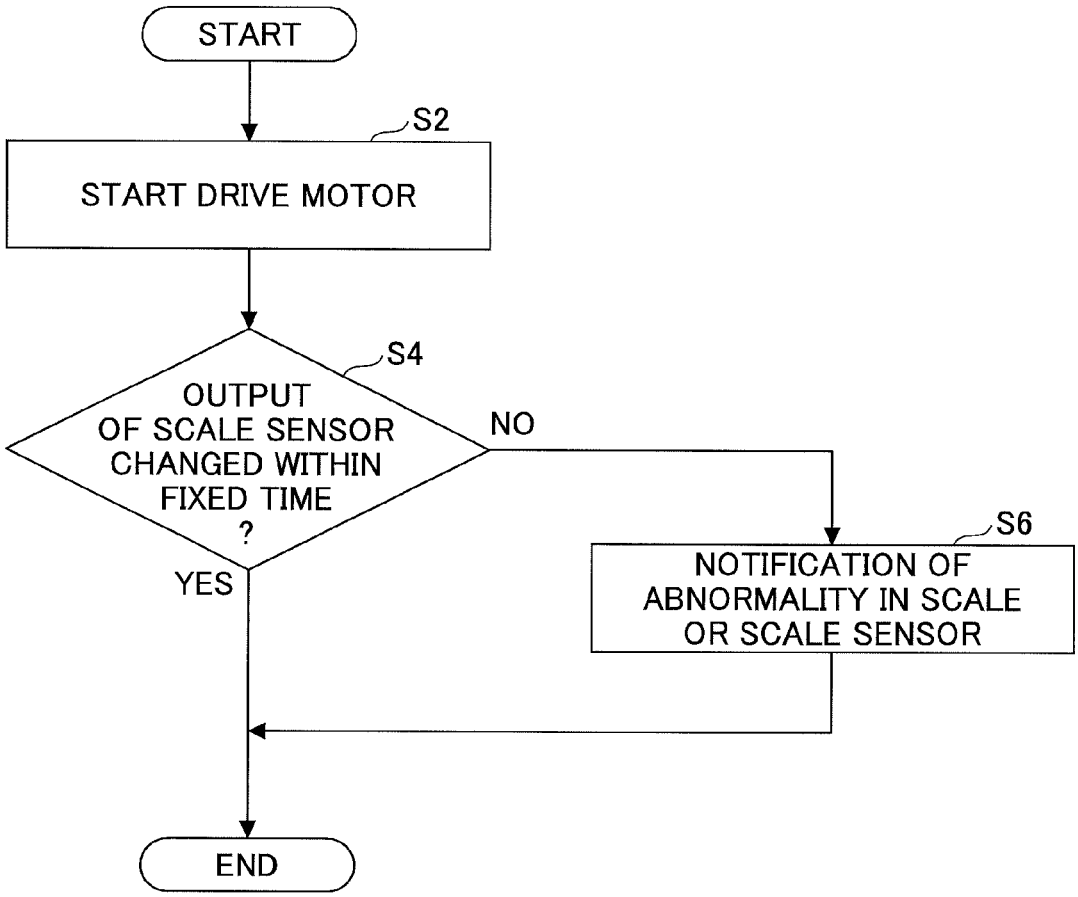
FIG. 2 is a flowchart of a process according to a method of notifying of an abnormality in a belt scale and a scale sensor.

A description will be given below, with reference to the drawings, of embodiments of the present invention.

First, a description will be given of the terms used in the following description. An image forming apparatus is, for example, a printer, a facsimile machine, a copy apparatus, a plotter, and a multifunction peripheral machine having a plurality of functions of the aforementioned apparatuses. A recording medium is a medium formed of a material such as, for example, paper, thread, fiber, leather, metal, plastic, glass, wood, ceramics, etc. In the following explanation, a print paper is used as a recording medium. An image formation means a formation of an image such as a character, a figure, a pattern, etc., on a recording medium, and also means an attachment of a liquid droplet (ink) onto a recording medium. An image carrier is, for example, a photoconductor drum. In the following explanation, a photoconductor drum is used as an image carrier. In the following explanation, an endless belt is, for example, an intermediate transfer belt, a travel speed signal outputting means is, for example, a scale sensor, and a width direction position signal outputting means is, for example, an edge sensor.

It should be noted that in the diagrams and flowcharts, component parts having the same function and steps performing the same process are given the same reference numerals and signs, and duplicate description will be omitted.

Figure 3:
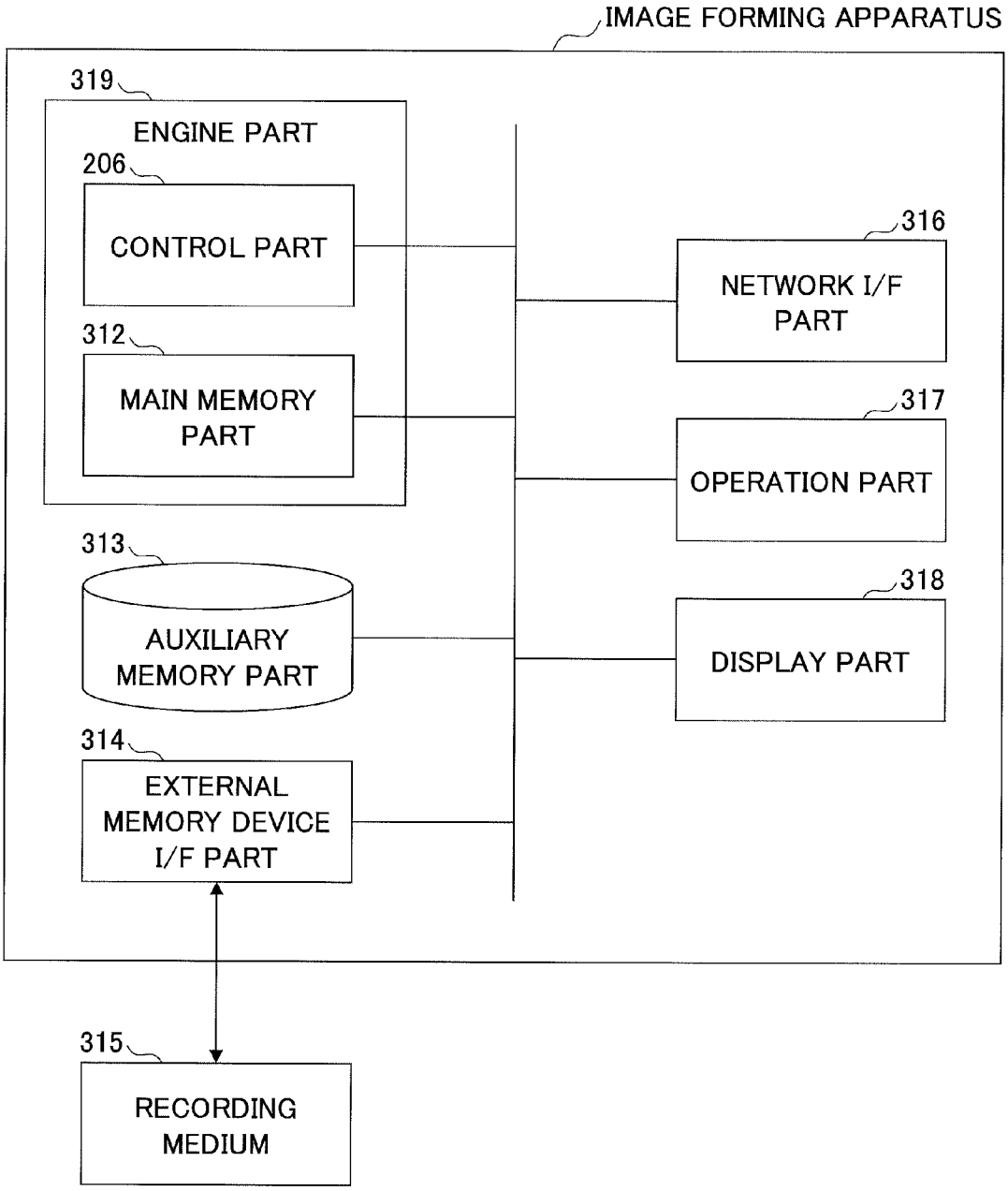
FIG. 3 is a block diagram illustrating a functional structure of an image forming apparatus according to an embodiment of the present invention.

FIG. 3 is a block diagram illustrating a functional structure of an image forming apparatus according to an embodiment of the present invention. The image forming apparatus illustrated in FIG. 3 includes an auxiliary memory part 313, an external memory I/F part 314, a network I/F part 316, an operation part 317, a display part 318, and an engine part 319. The engine part 319 includes a control part 206 and a main memory part 312.

The control part 206 is realized by a CPU, which performs a control of each device and an operation and processing of data. The control part 206 serves as an arithmetic unit, which executes programs stored in the main memory part 312. The control part 206 receives data from an input device and a memory device, and outputs the data to an output device and a memory device after operating and processing the data.

The main memory part 312 is a memory device including a ROM (Read Only Memory) and a RAM (Random Access Memory). The main memory part 312 stores or temporarily saves data and programs such as an operating system (OS), which is basic software, and application software that are executed by the control part 206.

The auxiliary memory part 313 is a HDD (Hard Disk Drive) etc., and is a memory device to store data relating to the application software, etc. The external memory I/F part 314 is an interface between the image forming apparatus and a storage medium 315 (for example, a flash memory) connected through a data transmission path such as a USB (Universal Serial Bus).

A predetermined program is stored in the storage medium 315. The program stored in the storage medium 315 is installed in the image forming apparatus through the external memory I/F part 314. Thereby, the predetermined program can be executed by the image forming apparatus.

The network I/F part 316 is an interface between the image forming apparatus and a peripheral apparatus having a communication function and connected through a network such as a LAN (Local Area Network) or a WAN (Wide Area Network) constructed by data transmission lines such as a hard wire and/or a wireless line.

The operation part 317 and the display part 318 are constructed by a key switch (hard key) and a LCD (Liquid Crystal Display) having a touch panel function (including software key of GUI (Graphical User Interface)). The operation part 317 and the display part 318 together used as an input device serving as a UI (User Interface) when using functions provided by the image forming apparatus.

The engine part 319 includes mechanism parts such as a plotter and a scanner, which actually perform a process relating to an image formation, and parts for driving motors, etc.

Figure 4:
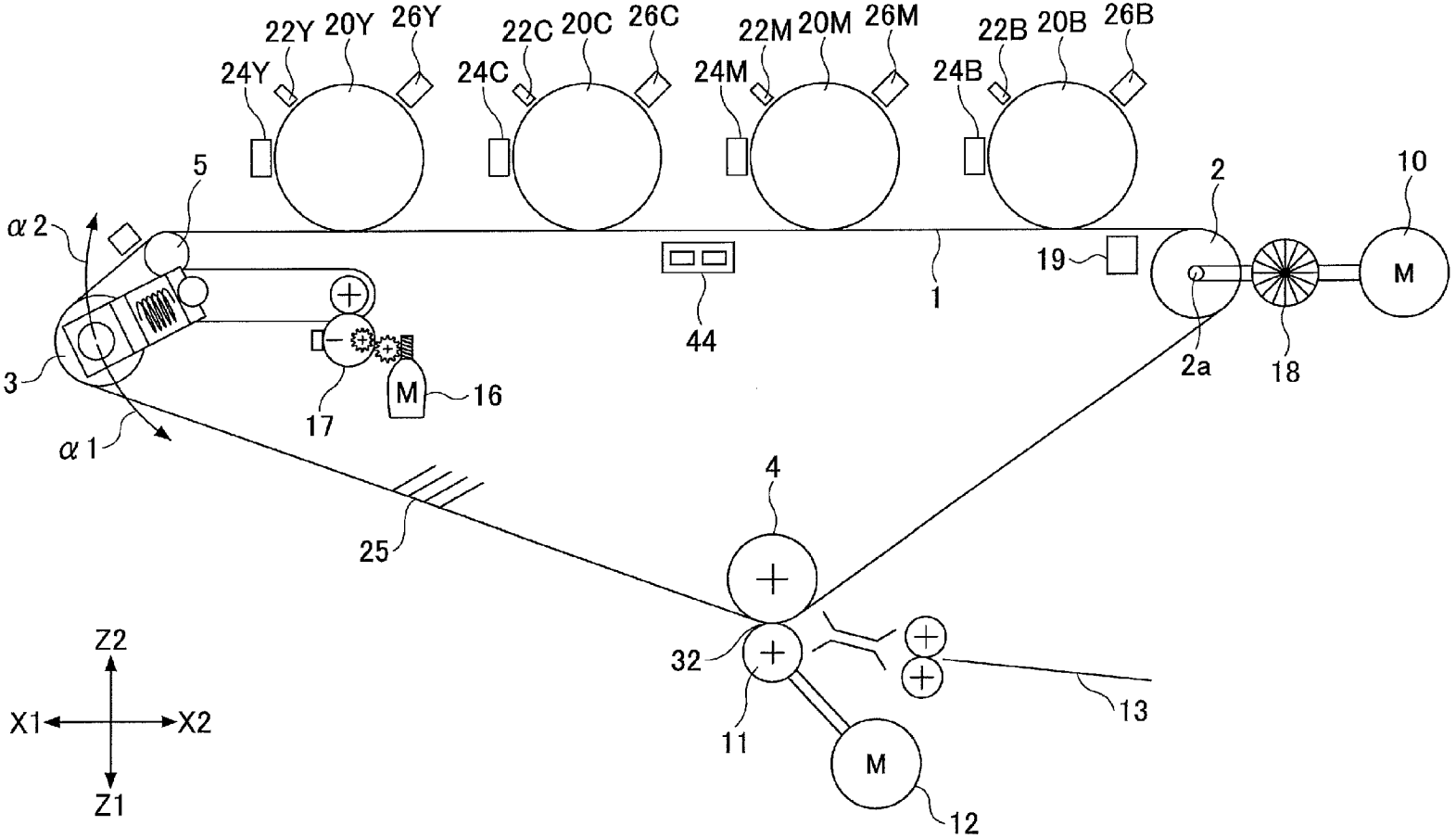
FIG. 4 is an illustration of an image forming part of the image forming apparatus.

FIG. 4 is an illustration of an image forming part of the image forming apparatus according to the present embodiment. In the example illustrated in FIG. 4, the intermediate transfer belt 1, which is an endless belt, is supported by a drive roller 2, a steering roller 3, a tension roller 4 and an idle roller 5 with a predetermined tension force. Four photoconductor drums 20Y, 20C, 20M, and 20B of Y (yellow), M (magenta), C (cyan), and B (black) are arranged along the intermediate transfer belt 1. In the following explanation, when color is not specified, the suffixes may be omitted and the photoconductor drums may be collectively referred to as photoconductor drum 20. The number of the photo conductor drums 20 is not limited to four. The photoconductor drums 20Y, 20C, 20M and 20B have exposure units 22Y, 22C, 22M and 22B, development units 24Y, 24C, 24M and 24B, and charge units 26Y, 26C, 26M and 26B, respectively. Each of the exposure units 22Y, 22C, 22M and 22B includes, for example, a polygon mirror.

The intermediate transfer belt 1 is provided with a belt scale 25 over the entire circumference. In FIG. 4, only a part of the belt scale 25 is illustrated for the sake of simplification of the drawing. In the middle of the travel path of the intermediate transfer belt 1, scale sensors 44A and 44B are arranged to detect a rotation speed of the intermediate transfer belt 1. The rotation speed of the intermediate transfer belt 1 can be acquired by the scale sensors 44A and 44B detecting the belt scale 25 while the intermediate transfer belt 1 is rotating.

The tension roller 4 is arranged opposite to and pressed against a secondary transfer roller 11 with the intermediate transfer belt 1 interposed therebetween. A secondary transfer part 32 is formed by the tension roller 4 and the secondary transfer roller 11.

A description will be given below of a process procedure when forming a color image using the image forming apparatus according to the present embodiment. When a start button of the image forming apparatus is pressed by a user or a print command is input into the image forming apparatus, the photoconductor drums 20Y, 20C, 20M and 20B, the intermediate transfer belt 1 and the secondary transfer roller 11 are rotationally driven at almost equal speeds. An encoder 18 is attached to a rotation axis 2*a* of the drive roller 2. The encoder 18 detects a rotation speed of the drive roller 2. The intermediate transfer belt 1 can be rotated at a fixed speed by feeding back the detected rotation speed to a drive motor 10.

Similarly, a motor and an encoder (both not illustrated in the figure) are attached to each of the photoconductor drums 20Y, 20C, 20M and 20B and the secondary transfer roller 11. A rotation speed of each of the photoconductor drums 20Y, 20C, 20M and 20B and the secondary transfer roller 11 is detected by the respective one of the encoders. The rotation speed detected by each of the encoders is fed back to the respective one of the motors so that each of the photoconductor drums 20Y, 20C, 20M and 20B and the secondary transfer roller 11 rotates at a fixed speed.

The charge units 26Y, 26C, 26M and 26B uniformly charge the photoconductor drums 20Y, 20C, 20M and 20B, respectively. The exposure units 22Y, 22C, 22M and 22B scan laser lights corresponding to images of each color at a predetermined timing based on an image signal input thereto in order to form latent images on the photoconductor drums 20Y, 20C, 20M and 20B, respectively. The development units 24Y, 24C, 24M and 24B develop the latent images by a single-color developer (for example, toner), respectively, so as to form visible images (single-color toner images are formed).

When the single-color toner images are primarily transferred onto the intermediate transfer belt 1, a full-color toner image is formed on the intermediate transfer belt 1. Simultaneously, a print paper 13 is fed from a paper supply tray or a manual feed tray. The color toner image primarily transferred on the intermediate transfer belt 1 reaches the secondary transfer part 32 at a timing when the print paper 13 reaches the secondary transfer part 32. Then, the secondary transfer part 32 transfers the color toner image of the intermediate transfer belt 1 onto the print paper 13. Here, a moving direction of the intermediate transfer belt 1 is set as X1-X2 direction in a plane where the intermediate transfer belt 1 faces the photoconductive drum 20, that is, in a plane (hereinafter, referred to as an opposite plane 1*a*) between the drive roller 2 and the idle roller 5.

Figure 5:
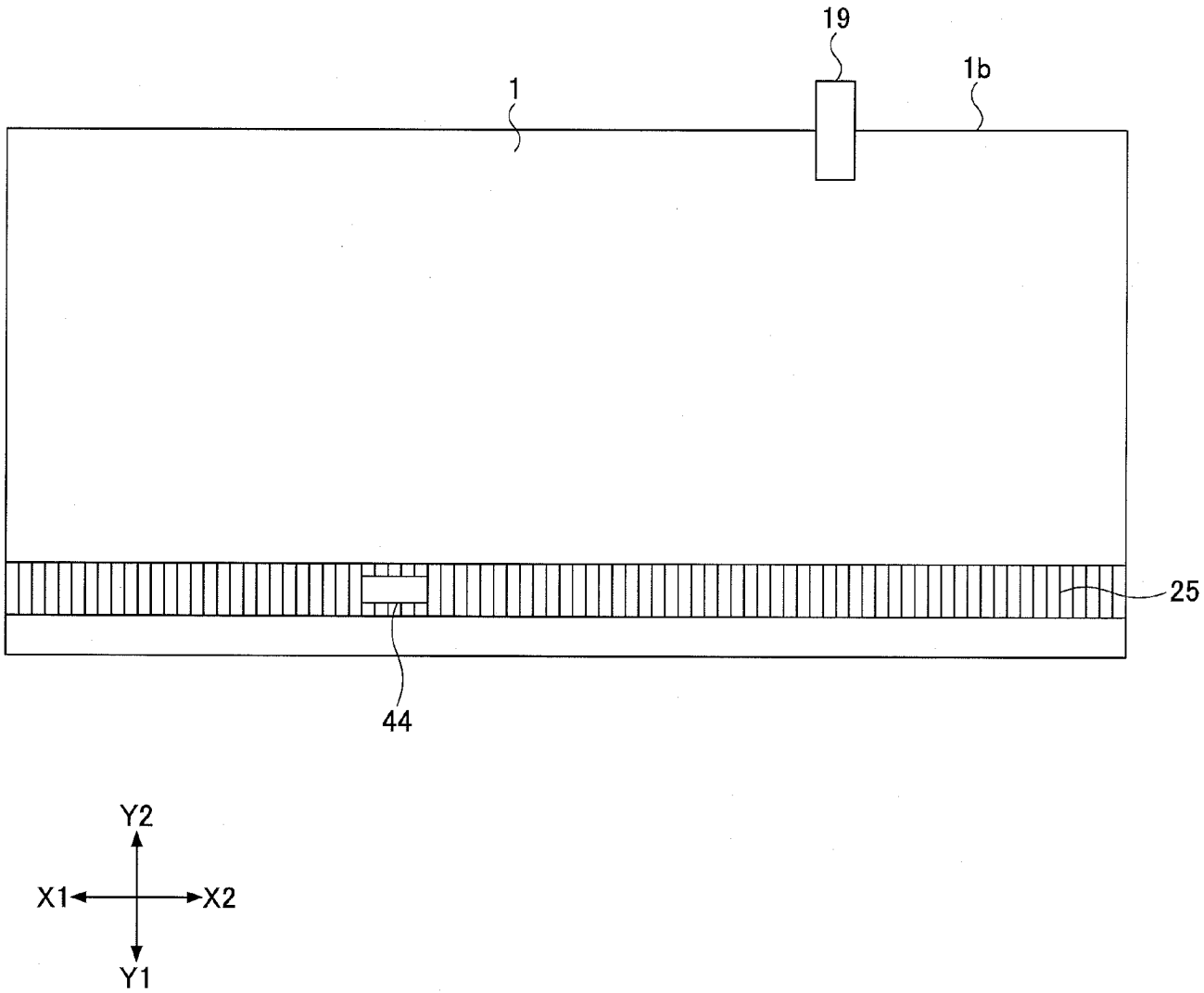
FIG. 5 is a plan view of the intermediate transfer belt and an edge sensor to illustrate a positional relationship between the intermediate transfer belt and the edge sensor.

FIG. 5 is a plan view of the intermediate transfer belt and an edge sensor to illustrate a positional relationship between the intermediate transfer belt and the edge sensor. In the example illustrated in FIG. 5, the edge sensor 19 is arranged at the end of the intermediate transfer belt 1 in the width direction. Here, the width direction of the intermediate transfer belt 1 is set as a Y1-Y2 direction. The edge sensor 19 detects the edge (side or end) of the intermediate transfer belt 1. That is, the edge sensor 19 detects the position of the intermediate transfer belt 1 in the width direction (Y1-Y2 direction). The term "meandering" explained below means that the intermediate transfer belt 1 moves in the Y1-Y2 direction. Moreover, the term "meandering control" means a control of adjusting the position of the intermediate transfer belt 1 in the width direction.

Figure 6:
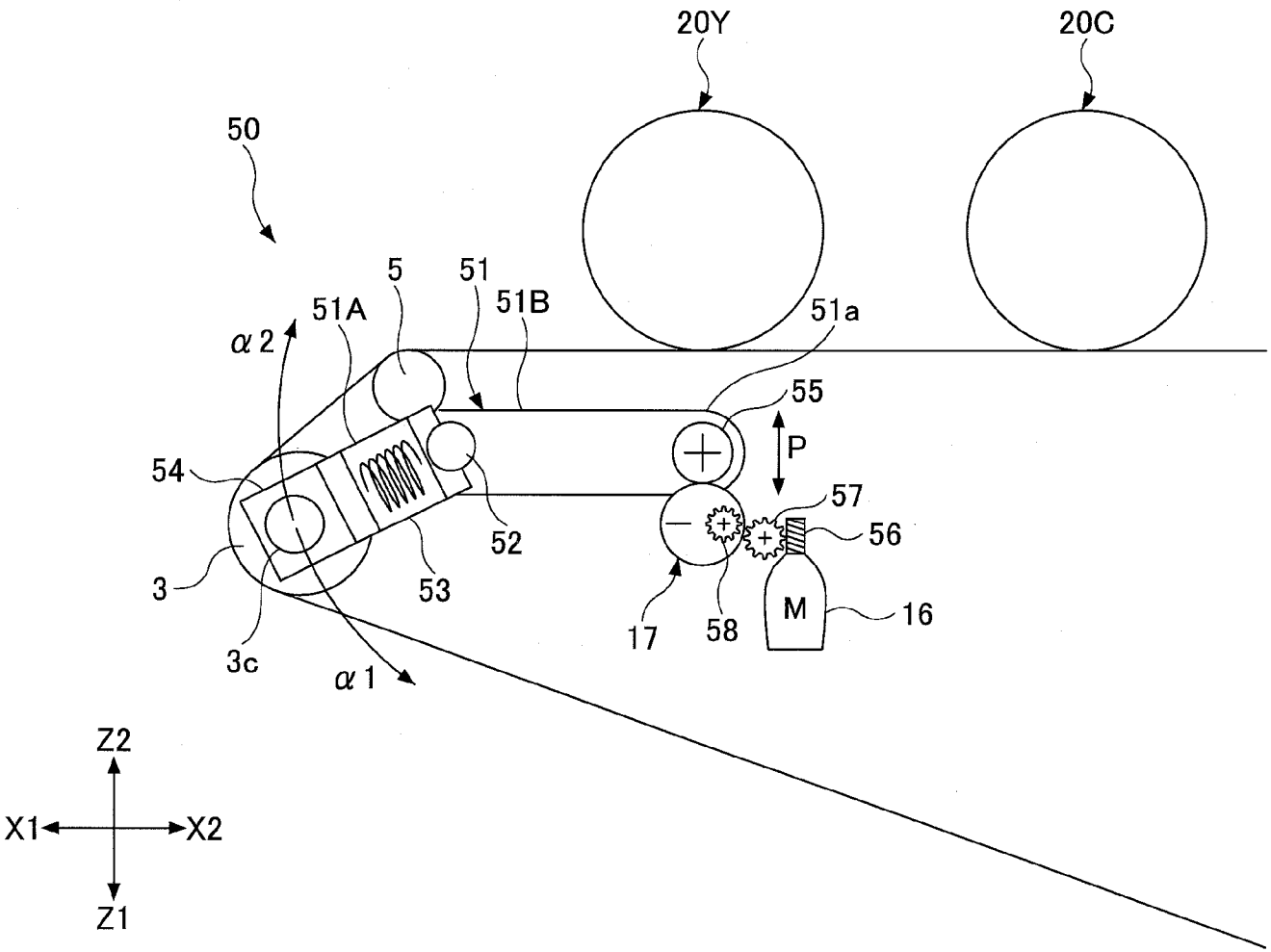
FIG. 6 is an illustration of a correction part for correcting a position of the intermediate transfer belt 1 in a width direction.

FIG. 6 is an illustration of a correction part for correcting the position of the intermediate transfer belt 1 in the width direction. The correction part 50 corrects the position of the intermediate transfer belt 1 in the width direction by inclining the steering roller 3. The correction part 50 includes an arm member 51 having a generally boomerang shape. A middle part of the arm member 51 is supported by an axis member 52. Opposite ends of the arm member 51 are rotatable about the axis member 52 as a center of rotation. Additionally, the arm member 51 has a left half part 51A and a right half part 51B with the axis member 52 at the center thereof. The right half part 51A includes an axis support member 54 and an elastic material 53 (for example, a spring). The axis support member 54 rotatably supports a rotation axis 3*c* of the steering roller 3. The elastic material 53 urges the axis support member 54 (an end of the rotation axis 3*c* of the steering roller 3) in the X1 direction (that is, a direction toward an outside of the area surrounded by the intermediate transfer belt 1).

On the other hand, an engagement roller 55 is provided on an end part 51*a* of the right half part 51B. The engagement roller 55 is engaged with an eccentric cam 17. A gear 58 is attached to the eccentric cam 17. When the steering motor 16 is driven, the drive force of the steering motor 16 is transmitted to a gear 57 through a worm gear 56, which results in a rotation of the gear 58 and also a rotation of the eccentric cam 17. When the eccentric cam 17 rotates, the end part 51*a* on which the engagement roller 55 is provided, is moved in a vertical direction (the direction of P; the Z1-Z2 direction of FIG. 6).

The middle part of the arm member 51 is supported by the axis member 52. The axis support member 54 serves as a free end of the arm member 51, and, thus, the axis support member 54 is rotatable. The rotation direction of the axis support member 54 is a direction ($\alpha$1-$\alpha$2 in FIG. 6) along an arc about the axis member 52 as a center. The axis support member 54 is rotatable in the direction $\alpha$1-$\alpha$2 by the end part 51*a* of the right half part 51B of the arm member 51 moving in the vertical direction (P direction).

Moreover, as mentioned above, the end of the rotation axis 3*c* of the steering roller 3 is urged by the elastic material 53. Accordingly, the end of the rotation axis 3*c* of the steering roller 3 is rotatable in the moving direction (X1 direction) of the intermediate transfer belt 1 or a direction (X2 direction)

opposite to the moving direction of the intermediate transfer belt 1 in association with the rotation of the axis support member 54 in the α1-α2 direction.

As mentioned above, when the axis support member 54 is rotated in the α1 direction, the end of the rotation axis 3*c* of the steering roller 3 is moved in the X1 direction, and when the axis support member 54 is rotated in the α2 direction, the end of the rotation axis 3*c* of the steering roller 3 is moved in the X2 direction. The correction part 50 is not provided on the other end of the rotation axis 3*c* of the steering roller 3. Accordingly, when the end of the rotation axis 3*c* of the steering roller 3 is moved in the X1 direction or the X2 direction, the rotation axis 3*c* of the steering roller 3 is inclined with respect to a vertical direction of the sheet of FIG. 6 (that is, the width direction of the intermediate transfer belt 1). If the steering roller 3 inclines with respect to the width direction, the intermediate transfer belt 1, which is rotated while being engaged with the steering roller 3, is moved in the inclining direction. Thereby, a position of the intermediate transfer belt 1 in the width direction can be adjusted. The correction part 50 is not limited to the mechanism illustrated in FIG. 6, and any mechanism, which can move the end of the rotation axis 3*c* of the steering roller 3 in the X1 direction or the X2 direction, may be used.

Figure 7:
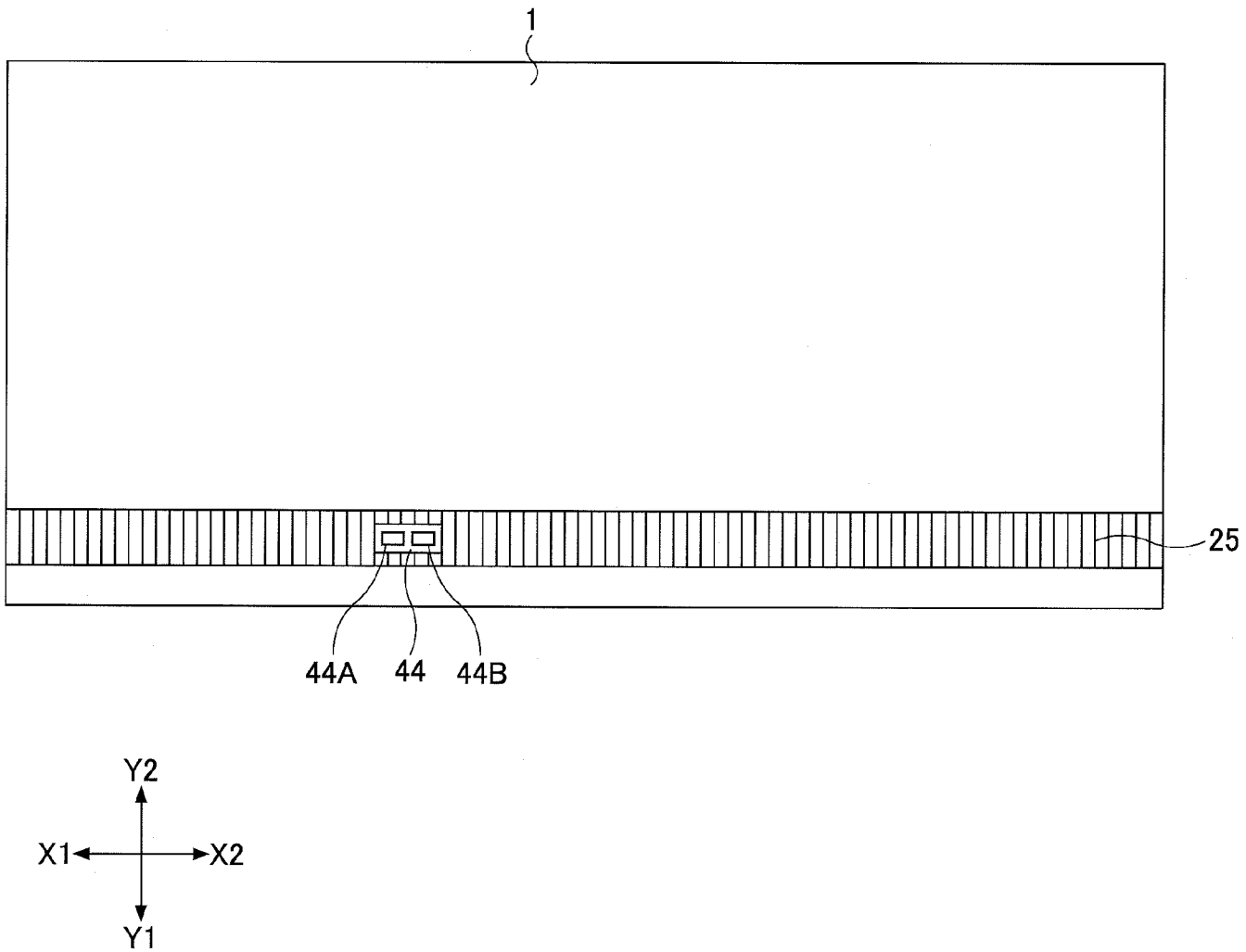
FIG. 7 is a plan view illustrating a belt scale and a scale sensor.

A description will be given below of the belt scale and the belt sensor. FIG. 7 is a plan view illustrating the belt scale 25 and the scale sensor 44. In the example illustrated in FIG. 7, the scale sensor 44, which contains two sensors 44A and 44B, is arranged to opposite to the belt scale 25. The sensors 44A and 44B are arranged close to each other along the belt scale 25. The belt scale 25 is provided on the backside of the intermediate transfer belt 1 along one side of the intermediate transfer belt 1 in the width direction.

Each of the sensors 44A and 44B detects an interval of the scale by optically reading the belt scale 25. The scale of the belt scale 25 is provided over the entire circumference of the intermediate transfer, belt 1 at an equal interval. Accordingly, if the moving speed of the intermediate transfer belt changes, the interval of the scale of the belt scale 25 detected by the sensors 44A and 44B also changes. In the feedback control of the intermediate transfer belt 1, the moving speed of the intermediate transfer belt 1 can be accurately controlled by controlling the number of revolution of the drive motor 10 (refer to FIG. 4) so that the interval of the scale detected by one of the sensors 44A and 44B is maintained constant.

A description will be given below, with reference to FIGS. 8A through 8E, of a structure and function of the scale sensor 44. The sensors 44A and 44B of the scale sensor 44 are sensors of the same structure. Each of the sensors 44A and 44B is, for example, a reflection type optical sensor equipped with a pair of light-emitting part 44*a* and a light-receiving part 44*b*, as illustrated in FIG. 8A. The belt scale 25 is a scale in which reflective parts 25*a* and non-reflective parts 25*b* are arranged alternately, as illustrated in FIG. 8B.

Each of the sensors 44A and 44B receives, by the light-receiving part 44*b*, a light projected by the light-emitting part 44*a* toward the belt scale 25 and reflected by the reflective parts 25*a* of the belt scale 25. In this circumstance, the light amount of the light reflected by the reflective parts 25*a* differs from the light amount of the light reflected by the non-reflective parts 25*b*.

Thus, as illustrated in FIG. 8C, each of the sensors 44A and 44B reads optically the belt scale 25 (reflective parts 25*a* and non-reflective parts 25*b*), and obtains the analog signal waveform of a sine wave. As illustrated in FIG. 8D, the analog signal waveform is converted into a digital signal by a circuit in the scale sensor 44, and is output as a signal of two values of High and Low, as illustrated in FIG. 8D. In addition, the scale sensor 44 outputs simultaneously the analog signal waveforms of the sensors 44A and 44B.

Because each of the sensors 44*a* and 44B is of a type which outputs a High signal when the light-receiving part 44*b* receives a light, a range t illustrated in FIG. 8D of the signal output from the scale sensor 44 corresponds to the value when the reflective part 25*a* is passing the scale sensor 44. Accordingly, in association with the rotation of the intermediate transfer belt 1, the output value of the scale sensor 44 changes between High and Low as illustrated in FIG. 8D due to existence and non-existence of the reflective part 25*a* passing through the detection range of the sensors 44A and 44B. Thus, the moving speed of the surface of the intermediate transfer belt 1 (rotation speed of the intermediate transfer belt 1) can be detected by acquiring a time period S from a time at which the signal changes from Low to High until a time at which the signal changes from High to Low next. It should be noted that the sensor output illustrated in FIG. 8D is a digitalized analog output waveform of the sensor 44A, and the same digital signal may be obtained from the analog output waveform of the sensor 44B.

As mentioned above, the scale sensor 44 detects the rotational moving speed of the intermediate transfer belt 1. According to the detected rotational moving speed, the engine part 319 controls the rotation speed of the drive motor 10 (refer to FIG. 4) in order to control the rotational moving speed of the intermediate transfer belt 1 to be fixed to a previously set basic speed.

Namely, the engine part 319 outputs a signal for driving the drive motor 10, and controls the drive motor 10 so that the intermediate transfer belt 1 rotates at the basic speed (constant speed). When the intermediate transfer belt 1 rotationally moves, the scale sensor 44 reads the belt scale 25 on the intermediate transfer belt 1, and feeds back the detection information (namely, information regarding the rotational moving speed of the intermediate transfer belt 1) to the engine part 319.

If the rotational moving speed of the intermediate transfer belt 1 obtained from the detection information, which is fed back, is equal to the basic speed, the engine part 319 controls the intermediate transfer belt 1 to move continuously at the basic speed by maintaining the rotation speed (number of revolutions) of the drive motor 10. On the other hand, if the rotational moving speed of the belt 1 obtained from the detection information, which is fed back, differs from the basic speed, the engine part 319 calculates the difference and controls the moving speed (number of revolutions) of the drive motor 10 so that the rotational moving speed of the intermediate transfer belt 1 becomes equal to the basic speed.

Here, that the scale sensor 44 outputs the pulse signal (digital signal) illustrated in FIG. 8D indicates that the output of the sensor 44A or the sensor 44B of the scale sensor 44 is changed (between High and Low). In such a case, it can be regarded that the sensor 44A or the sensor 44B is normally detecting the belt scale 25. On the other hand, if the output of the sensor 44A or the sensor 445 does not change, it can be regarded that the pulse signal illustrated in FIG. 8D is not output from the sensor 44A or the sensor 44B, that is, the sensor 44A or the sensor 445 outputs, for example, a flat signal as illustrated in FIG. 8E. In such a case, it can be regarded that the sensor 44A or the sensor 44B is not normally detecting the belt scale 25.

A description will be given of a phase difference between the outputs of the sensors 44A and 445. As illustrated in FIG. 8C, each of the sensors 44A and 44B outputs the analog signal waveform. Because the sensors 44A and 44B are arranged at different positions in the longitudinal direction of the belt scale 25, the phase of the analog signal waveform of the sensor 44A differs from the phase of the analog signal waveform of the sensor 44B. That is, there is a phase difference between the outputs of the sensors 44A and 44B. If the length of the belt scale 25 is always constant, the phase difference between the outputs of the sensors 44A and 44B is also always constant. In the example illustrated in FIG. 8C, the phase of the analog signal waveform of the sensor 44A differs from the phase of the analog signal waveform of the sensor 44B by 90 degrees. In other words, the sensors 44A and 44B are arranged at positions where the phase difference between the outputs of the sensors 44A and 44B is set to 90 degrees.

Here, if an elongation is generated in the intermediate transfer belt 1, the belt scale 25 is elongated and the length of the belt scale is slightly lengthened. Thus, the scale interval of the belt scale 25 is increased, but the interval between the sensor 44A and the sensor 44B is maintained without change, which results in the phase difference obtained from the outputs of the sensors 44A and 44B is decreased. By detecting the change in the phase difference, an elongation or contraction generated in the intermediate transfer belt 1 (the belt scale 25) can be detected. The degree of change in the phase difference corresponds to the elongation or contraction of the intermediate transfer belt 1. By using this, the elongation/contraction correction of the intermediate transfer belt 1 can be achieved.

Figure 9:
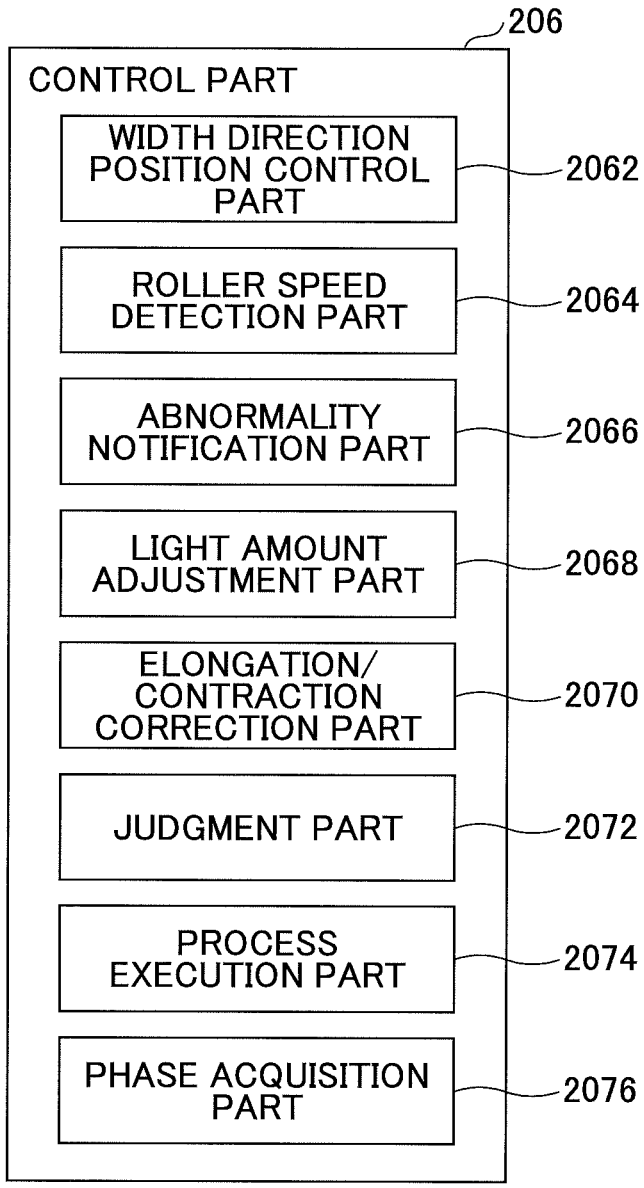
FIG. 9 is a functional block diagram of a control part, which controls a belt drive apparatus according to a first embodiment.

A description will be given below of a belt drive apparatus according to a first embodiment. FIG. 9 is a functional block diagram of the control part 206, which controls the belt drive apparatus according to the first embodiment. The control part 206 includes a width direction position control part 2062, a roller speed detection part 2064, an abnormality detection part 2066, a light-amount adjustment part 2068, an elongation/contraction correction part 2070, a judgment part 2072, and a process execution part 2074.

The edge sensor 19 (width direction position signal output part) illustrated in FIG. 5 detects a position of the intermediate transfer belt 1 in the width direction, and outputs a signal indicating the detected position (hereinafter, referred to as "position signal"). The sensors 44A and 44B (moving speed signal detection part) of the scale sensor 44 illustrated in FIG. 7 detects the rotational movement of the intermediate transfer belt 1, and outputs a signal. The width direction position control part 2062 controls the position (position in the Y1-Y2 direction in FIG. 5) of the intermediate transfer belt 1 in the width direction.

In the following explanation, a control of the position of the intermediate transfer belt 1 in the width direction is referred to as a meandering control. The meandering control is performed using the correction part 50 (refer to FIG. 6).

Figure 10A:
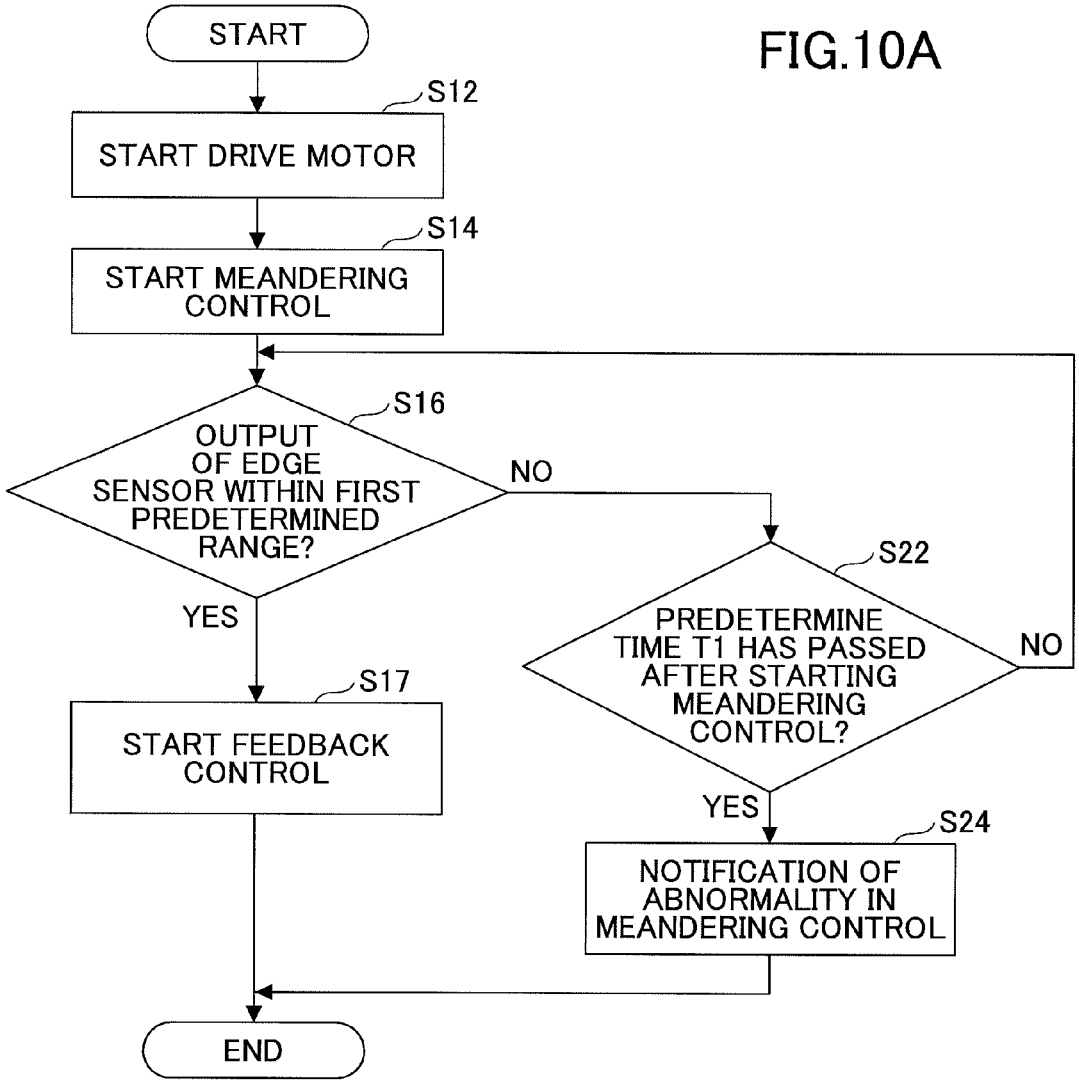
FIG. 10A is a flowchart of a control process of the belt drive apparatus according to the first embodiment.

FIG. 10A is a flowchart of a control process of the belt drive apparatus according to the first embodiment. First, the control part 206 starts a driving operation of the drive motor 10 (refer to FIG. 4) in order to rotate the intermediate transfer belt 1 (step S12). Then, the width direction position control part 2062 in the control part 206 starts the meandering control of the intermediate transfer belt (step S14).

Then, the judgment part 2072 judges whether the position signal from the edge sensor 19 is within a first predetermined range (step S16). Here, a description is given of the first predetermined range. The first predetermined range is set so that the edge sensor 19 can detect the edge of the intermediate transfer belt 1 and the sensors 44A and 44B of the scale sensor 44 can detect the belt scale 25.

Figure 11:
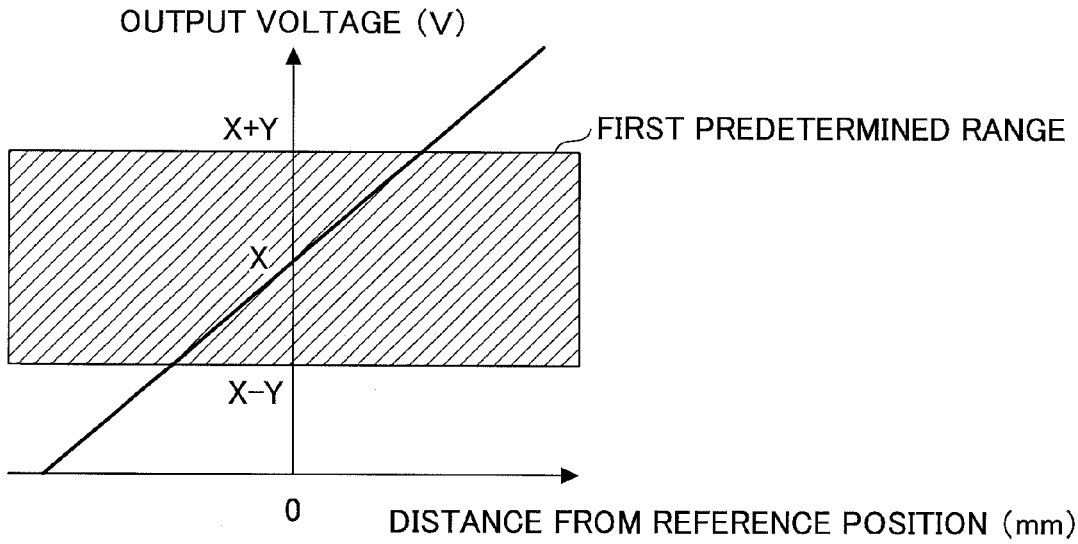
FIG. 11 is an illustration indicating a first predetermined range.

FIG. 11 is an illustration indicating the first predetermined range. In the example illustrated in FIG. 11, the position signal output by the edge sensor 19 is an output voltage. In FIG. 11, the horizontal axis represents a distance from a reference position to the belt scale 25, and the vertical axis represents the output voltage of the edge sensor 19. In the example illustrated in FIG. 11, the reference position of the intermediate transfer belt 1 (the belt scale 25) corresponds to the position at which the scale sensor 44 is reading the center of the belt scale 25. In a case where there is no variation in a belt edge 1*b* (refer to FIG. 5) or in a case where a belt edge component is eliminated, the edge sensor 19 outputs an output voltage proportional to a distance from the reference position to the belt edge 1*b*.

Then, the first predetermined range with respect to the output voltage of the edge sensor 19 is set beforehand (in FIG. 11, a hatched portion). The range where the sensors 44A and 44B of the scale sensor 44 can detect the belt scale 25 is determined based on the length of the belt scale 25 in a main scanning direction (the width direction of the intermediate transfer belt 1). Here, the first predetermined range is set to (X+Y)V to (X−Y)V, where Y is a value determined from the length of the belt scale 25 in the main scanning direction and a range where the belt sensor 25 can be detected, and Y is equal to about a half of the length of the belt scale 25 in the main scanning direction.

Returning to FIG. 10A, if the judgment part 2072 determines, in step S16, that the output of the edge sensor 19 falls within the first predetermined range, the process proceeds to step S17. Here, that the output of the edge sensor 19 is within the first predetermined range means that the edge sensor 19 can detect the edge of the intermediate transfer belt 1 (can detect the position of the intermediate transfer belt 1) and the scale sensor 44 can detect the belt scale 44 (can detect the moving speed of the intermediate transfer belt 1).

On the other hand, after the meandering control is started by the width direction position control part 2062 (step S14) and if the output voltage of the edge sensor 19 does not fall within the first predetermined range (NO of step A16) (for example, if the intermediate transfer belt 1 is displaced far away from the reference position immediately after attaching the intermediate transfer belt 1), the process proceeds to step S22. In step S22, the judgment part 2072 judges whether a predetermined time T1 has passed after the meandering control is started. If the predetermined time T1 has not passed, the process returns to step S16. If the predetermined time T1 has passed, the process proceeds to step S24. The process of step S24 will be explained later. According to the belt drive apparatus according to the present embodiment, proceeding to step S24 is delayed for the predetermined time T1 until the position signal (output voltage) of the edge sensor 19 falls within the first predetermined range.

A description of the step S17 will be given below. In the present embodiment, if the position signal falls within the previously determined first predetermined range within the predetermined time T1 after the start of the control by the width direction position control part 2062 (YES of step S16), the process execution part 2074 causes a predetermined process to start based on the signal of the scale sensor 44.

Although the predetermined process includes various processes, the predetermined process in the present embodiment is "a feedback process of the intermediate transfer belt 1 using the detection signal of the scale sensor 44". Then, the process execution part 2074 causes the feedback process of the intermediate transfer belt 1 to be performed (step S17).

On the other hand, if it is determined in step S22 that the predetermined time T1 has passed (YES of step S22), that is, if the output of the edge sensor 19 does not fall within the first predetermined range after the predetermined time T1 has passed, the abnormality notification part 2066 sends a notification of abnormality in the meandering control by the width direction position control part 2062 (step S24). The notification of abnormality will be explained later. The predetermined time T1 is a time period sufficient for the intermediate transfer belt 1 being moved by the meandering control of the width direction position control part 2062.

In the belt drive apparatus according to the above-mentioned first embodiment, the feedback process of the intermediate transfer belt 1 is performed after the condition is established in that the scale sensor 44 can surely detect the belt scale (YES of step S16). Accordingly, the feedback process of the intermediate transfer belt 1 can be performed under an appropriate condition.

Figure 10B:
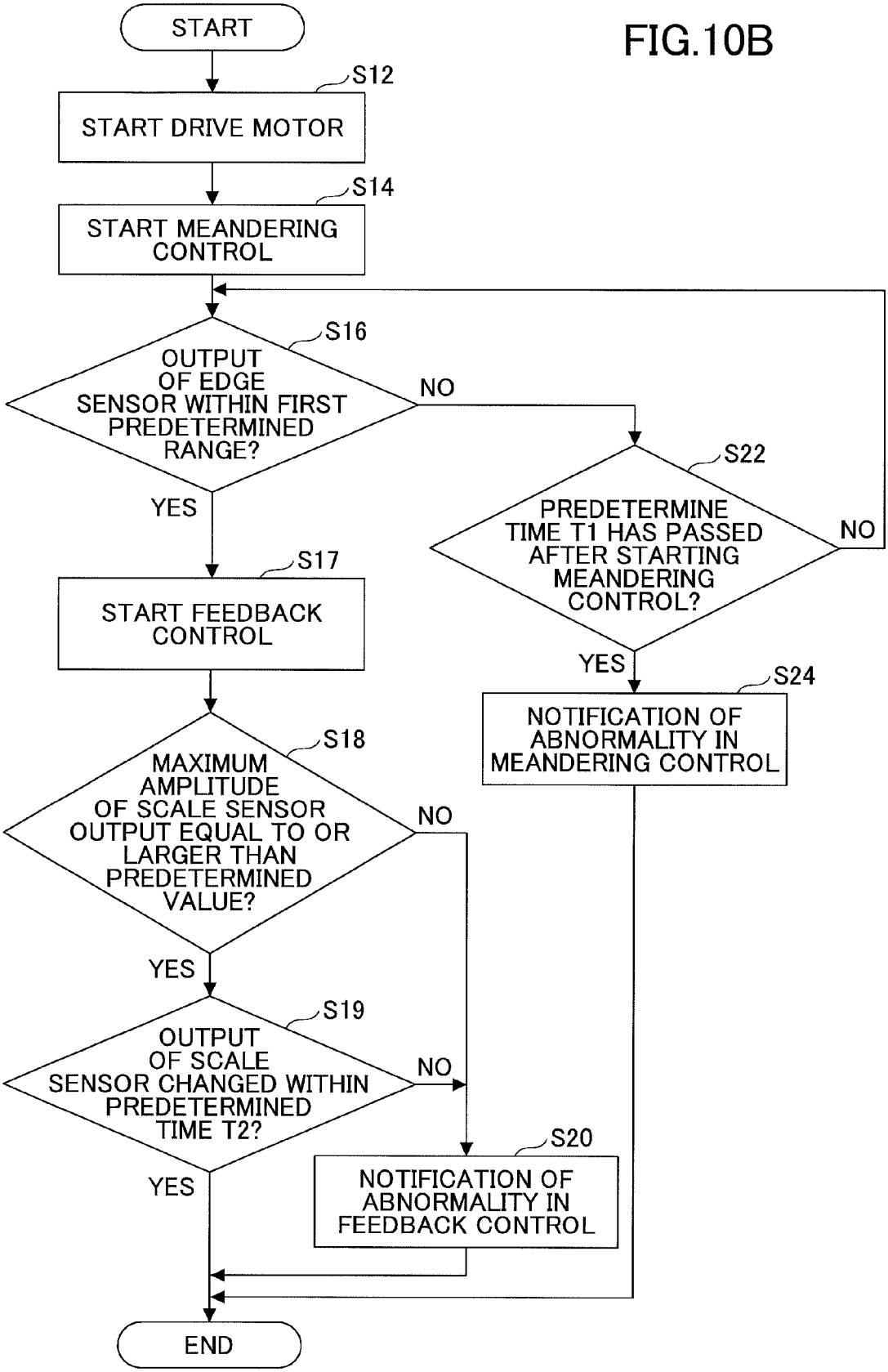
FIG. 10B is a flowchart of a control process of a belt drive apparatus according to a second embodiment.

A description will now be given of a second embodiment of the present invention. FIG. 10B is a flowchart of a control process of a belt drive apparatus according to the second embodiment.

The process illustrated in FIG. 10B is the same as the process illustrated in FIG. 10A except that steps S18 and S20 are added after the step S17. As illustrated in FIG. 10B, after the process of steps S12, S14, S16 and S17 is completed, the process proceeds to step S18.

In step S18, the judgment part 2072 judges whether the output signal from the scale sensor 44 is beyond a predetermined value. It should be noted that the output signal of the scale sensor 44 includes the output signals of the sensors 44A and 44B, but at least one of the output signals of the sensors 44A and 44B may be used in this process. If the output signal from the scale sensor 44 is smaller than a predetermined value (NO of step S18), the process proceeds to step S20. In step S20, the judgment part 2072 judges whether an abnormality occurs in the feedback process after the feedback process is started. That is, the judgment part 2072 judges whether the maximum amplitude ft (refer to FIG. 8C) of the analog output value of the scale sensor 44 is equal to or larger than a predetermined value (step S18). This judgment corresponds to judgment whether the scale sensor 44 is normally reading the belt scale 25.

Then, if the judgment part 2072 judges that the analog output value of the maximum amplitude of the scale sensor 44 is equal to or larger than the predetermined value (that is, the scale sensor 44 is normally detecting the belt scale 25) (YES of step S18), the process proceeds to step S19. The process of step S19 will be explained later.

On the other hand, if the maximum amplitude of the analog output signal of the scale sensor 44 is smaller than the predetermined value (that is, the scale sensor 44 is not normally detecting the belt scale 25) (NO of step S18), the process proceeds to step S20. In step S20, the abnormality judgment part 2066 sends a notification that there is an abnormality in the feedback process using the output signal of the scale sensor 44. Specifically, the abnormality in the feedback process includes an abnormality that the scale sensor 44 does not function normally due to dirt attached on the reading surface of the scale sensor 44 or the belt scale 25. This abnormality notification may be achieved by, for example, displaying the notification on the display part 319 (refer to FIG. 3). The notification may be sent to a service person via a network. The abnormality notification of step S24 of FIG. 10A and FIG. 10B may be performed in the same manner.

When the process proceeds from step S18 (YES of step S18) to step S19, the judgment part 2072 judges whether the output signal from the scale sensor 44 has changed within a predetermined time T2 (step S19). The predetermined time T2 is determined previously, and is set to a time period sufficient for a change being generated in the output signal of the scale sensor 44. This judgment corresponds to judgment whether the scale sensor 44 can normally detect the belt scale 25. The output signal of the scale sensor 44 means the pulse signal illustrated in FIG. 8D. Additionally, as mentioned above, the scale sensor 44 and the belt scale 25 together provide a feedback control function to control the intermediate transfer belt 1 to move at a fixed speed.

Then, if the judgment part 2072 judges that the output signal of the scale sensor 44 has changed (that is, if it is judged that the scale sensor 44 is normally detecting the belt scale 25 and outputs the pulse signal as illustrated in FIG. 8D) (YES of step S18), the abnormality judgment process is ended, and the normal feedback control of the intermediate transfer belt 1 is performed.

On the other hand, if the judgment part 2072 judges that the output signal of the scale sensor 44 has not changed (that is, if it is judged that the scale sensor 44 is not detecting the belt scale 25 normally and outputs the flat signal as illustrated in FIG. 8E) (NO of step S18), a notification is sent that there is an abnormality generated in the feedback process based on the output signal of the scale sensor 44 (step S20). Specifically, the abnormality in the feedback process includes an abnormality that the scale sensor 44 does not function normally due to dirt attached on the reading surface of the scale sensor 44 or the belt scale 25.

Then, if the judgment part 2071 judges that there is an abnormality, the abnormality notification part 2066 sends a notification that there is an abnormality. This abnormality notification may be achieved by, for example, displaying the notification on the display part 319 (refer to FIG. 3). The notification may be sent to a service person via a network. The abnormality notification of step S24 of FIG. 10A and FIG. 10B may be performed in the same manner.

Although the notification of an abnormality in the feedback process is sent in step S18 based on the judgment whether the output signal of the scale sensor 44 changes within the predetermined time T2, the notification may be sent based on judgment according to other methods.

In the belt drive apparatus according to the present embodiment, an abnormality in the width direction position control part 2062 and an abnormality in the feedback control function can be judged separately. Additionally, it is judged in step S16 whether the output of the edge sensor 19 falls within the first predetermined range. Then, if the output of the edge sensor 19 is within the first predetermined range (if the edge sensor 19 can detect the edge of the intermediate transfer belt 1 and the scale sensor 44 can detect the belt scale 25), the process execution part 2074 executes the predetermined process (the feedback process) using the output signal of the scale sensor 44. Then, it is determined in step S18 and step S19 whether there is an abnormality in the output of the scale sensor 44. Accordingly, no erroneous notification is sent that "the feedback process is abnormal" because of the reason that the scale sensor 44 cannot detect the belt scale 25 as the intermediate transfer belt 1 is far away from the reference position although there is no abnormality in the scale sensor 44 and the belt scale 25. As a result, an accurate notification of abnormality can be sent with respect to the scale sensor 44 and the belt scale 25.

In addition, although the process of step S19 is performed after the process of step S18 in the present embodiment, the process of step S19 may be performed before the process of step S18.

A description will be given below of a third embodiment of the present invention. The scale sensor 44 of the belt drive apparatus according to the third embodiment is an optical sensor having a light-emitting part 44*a* and a light-receiving part 44*b* as illustrated in FIG. 8A. Generally, if dirt is attached to the light-emitting part 44*a* or the light-receiving part 44*b*, an intensity of light (light amount) output from the light-emitting part 44*a* or an intensity of light (light amount) received by the light-receiving part is reduced. In such a case, it is necessary to perform a light amount adjustment process. In the present embodiment, the process execution part 2074 causes the light amount adjustment process to be executed.

Generally, when performing the feedback control of the intermediate transfer belt 1, the light amount adjustment process is performed when replacing the intermediate transfer belt 1 and replacing the scale sensor 44 so that the scale sensor 44 outputs a stable signal (voltage). The light amount adjustment process is executed by a light amount adjustment execution instruction being issued when the image forming apparatus is turned on after replacement of the intermediate transfer belt 1 and/or the scale sensor 44.

According to a conventional light amount adjustment process, when the light amount adjustment execution command is issued, the light amount adjustment is performed immediately. Accordingly, if the scale sensor 44 cannot detect the belt scale 25 appropriately because the intermediate transfer belt 1 is far away from the reference position, the light amount adjustment may not be performed accurately. Thus, the belt drive apparatus according to the present embodiment executes the light amount adjustment after a state is set where the scale sensor 44 can detect the belt scale 25 appropriately.

Figure 12A:
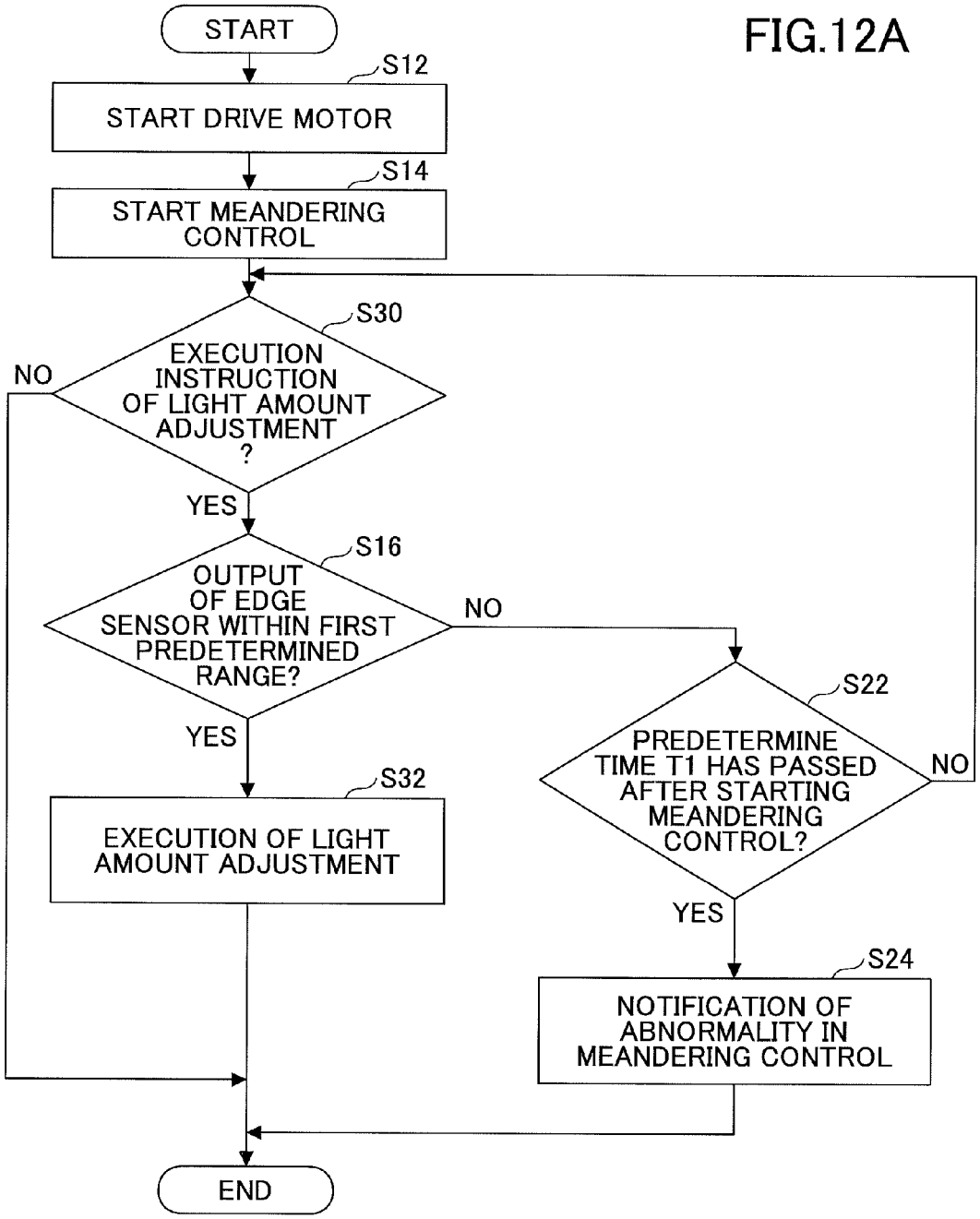
FIG. 12A is a flowchart of a control process of a belt drive apparatus according to a third embodiment.

FIG. 12A is a flowchart of a control process of the belt drive apparatus according to the third embodiment. After the process of step S12 and step S14 is ended, the judgment part 2072 judges whether the light amount adjustment instruction for the scale sensor 44 was issued by the light amount adjustment part 2068 (step S30). The light amount adjustment instruction is done by the light amount adjustment part 2068 sending a light amount adjustment instruction signal to the scale sensor 44.

If the judgment part 2072 judges that light amount adjustment instruction is not issued (NO of step S30), the process is ended.

On the other hand, if the judgment part 2072 judges that the light amount adjustment instruction is performed (YES of step S30), the process proceeds to step S16. If it is judged that the intermediate transfer belt 1 is situated at a position where the scale sensor 44 can detect the belt scale 25 (YES of step S16), the process proceeds to step S32. In step S32, the scale sensor 40 performs the light amount adjustment by increasing an amount of light emitted by the light-emitting part 44*a* or increasing a light sensitivity of the light-receiving part 44*b*.

In the belt drive apparatus according to the present embodiment, the scale sensor 44 performs the light amount adjustment process after the condition is established where the scale sensor 44 can detect the belt scale 25 (YES of step S16). Accordingly, the light amount adjustment process can be surely performed.

A description will be given below of a fourth embodiment of the present invention. In the fourth embodiment, a notification of abnormality in the light amount adjustment process of the belt drive apparatus according to the third embodiment is performed accurately.

Figure 12B:
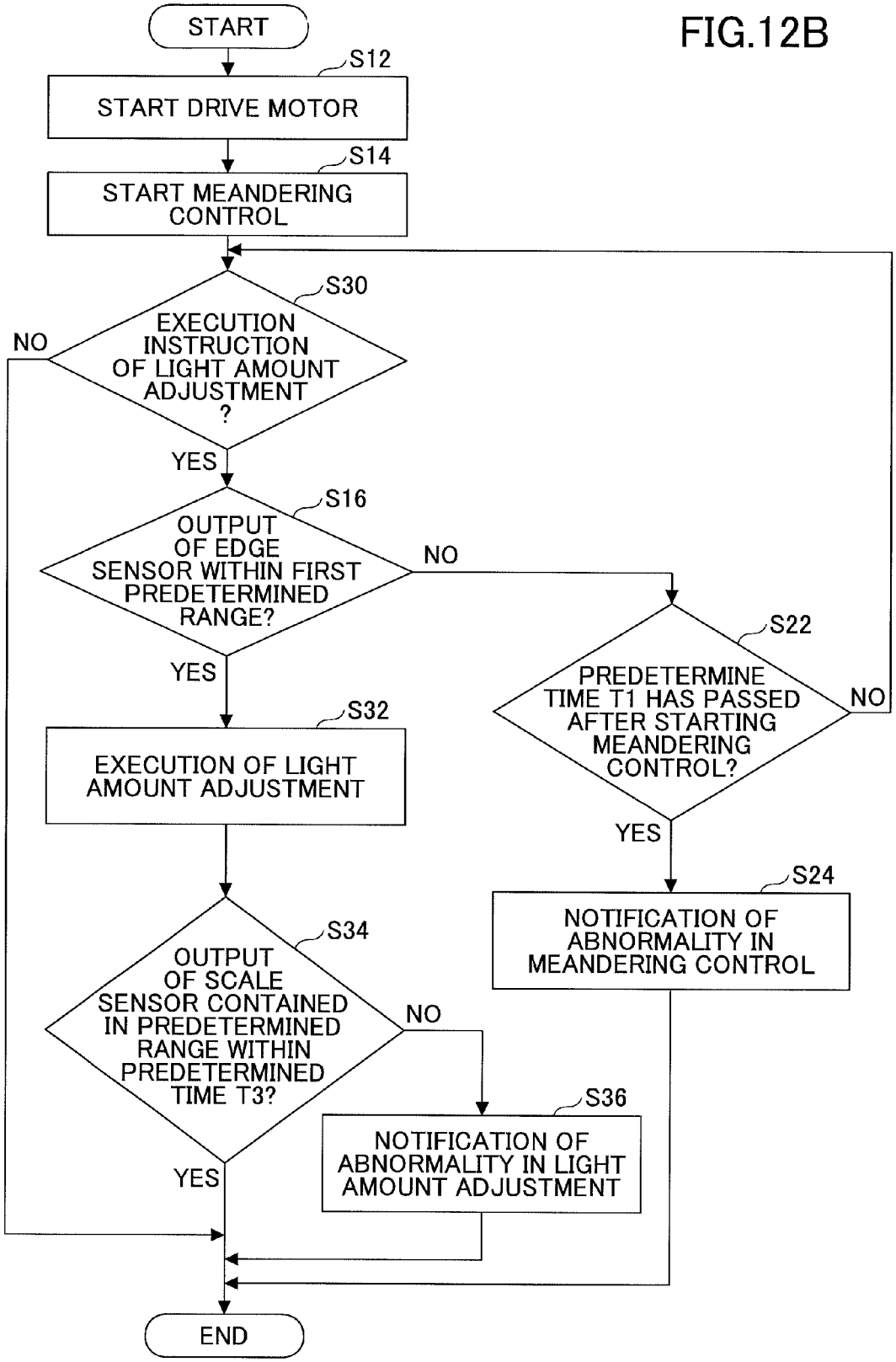
FIG. 12B is a flowchart of a control process of a belt drive apparatus according to a fourth embodiment.

FIG. 12B is a flowchart of a control process of the belt drive apparatus according to the fourth embodiment. After starting the light amount adjustment process (step S32), the judgment part 2072 judges whether there is an abnormality in the light amount adjustment process. Specifically, it is judged whether the output signal of the scale sensor 44 falls within a predetermined time T3 after the start of the light amount adjustment process (step S34). Here, the signal of the scale sensor 44 is a signal indicating an amount of light received by the light-receiving part 44*b*. For example, the signal of the scale sensor 44 corresponds to the maximum amplitude ft as illustrated in FIG. 8C. The predetermined time T3 is set to a time period sufficient for the signal of the scale sensor 44 falling within the second predetermined range.

If it is determined in step S34 that the output of the scale sensor 44 is within the second predetermined range (YES of step S34), the process is ended. On the other hand, if it is determined that the output of the scale sensor 44 is not within the second predetermined range (NO of step S34), the abnormality notification part 2066 sends a notification that the light amount adjustment process is abnormal. Here, the abnormality of the light amount adjustment process includes an abnormality in the light amount adjustment function in the scale sensor 44 and an abnormality in the light adjustment part 2068 in the control part 206.

According to the present embodiment, the judgment of abnormality in the light amount adjustment is performed after the intermediate transfer belt 1 moves to the position where the scale sensor 44 can detect the belt scale 25. Accordingly, no erroneous notification is sent that "there is an abnormality in the light amount adjustment function of the scale sensor 44 and the light adjustment part 2068 (that is, the light amount adjustment process)" because of the reason that the scale sensor 44 cannot detect the belt scale 25 as the intermediate transfer belt 1 is far away from the reference position although there is no abnormality in the light amount adjustment function of the scale sensor 44 and the light adjustment part 2068. As a result, an accurate notification of abnormality can be sent with respect to the scale sensor 44 and the belt scale 25.

A description will be given below of a fifth embodiment of the present invention.

Generally, when performing the feedback control of the intermediate transfer belt 1, a plurality of sensors 44A and 44B are provided in order to eliminate influences of an elongation/contraction of the intermediate transfer belt 1 due to a change in temperature and/or humidity. The phase acquisition part 2076 computes and acquires a phase difference between the output signals of the scale sensors 44A and 44B. A degree of an elongation/contraction of the intermediate transfer belt 1 is judged based on the phase difference acquired by the phase acquisition part 2076, and the moving speed of the intermediate transfer belt 1 is corrected. Here, the phase difference acquired immediately after the start of driving the intermediate transfer belt 1 in an initial state in the belt drive apparatus is referred to as an initial phase difference. An elongation/contraction of the intermediate transfer belt 1 is determined by comparing the initial phase difference and a phase difference acquired during a drive operation of the belt drive apparatus.

Generally, the initial phase difference acquisition process is performed at a time of replacing the intermediate transfer belt 1 and/or the scale sensor 44. A conventional initial phase difference acquisition process is performed immediately after an initial phase difference acquisition execution instruction is issued. However, depending on the position of the intermediate transfer belt 1 attached to the belt drive apparatus, there may be a case where the scale sensor 44 cannot detect the belt scale 25 and an accurate initial phase difference cannot be acquired. Thus, the belt drive apparatus according to the present embodiment is configured to be capable of acquiring an accurate initial phase difference even at a time of replacing the intermediate transfer belt 1 and/or the scale sensor 44.

Figure 13A:
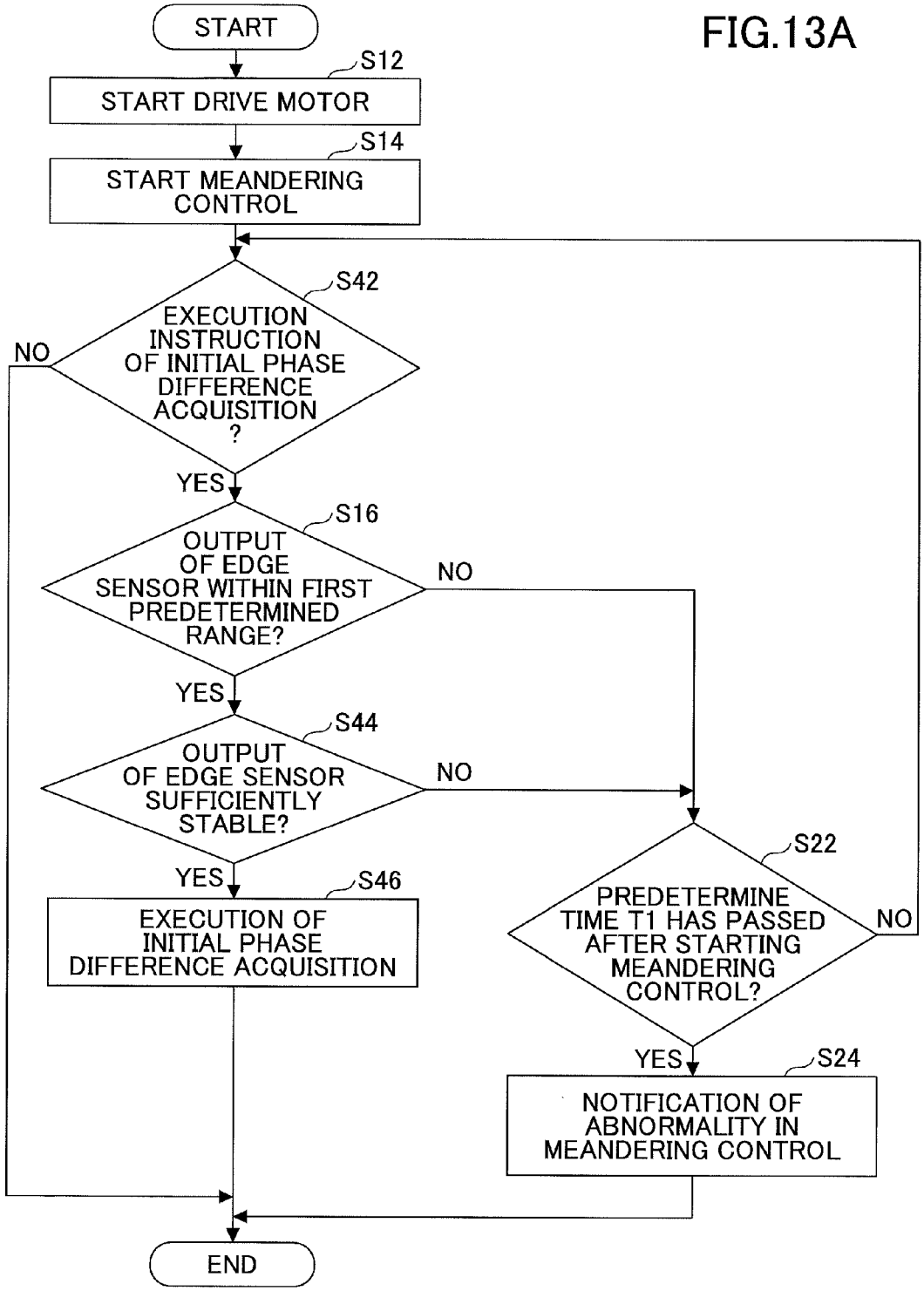
FIG. 13A is a flowchart of a control process of a belt drive apparatus according to a fifth embodiment.

FIG. 13A is a flowchart of a control process of the belt drive apparatus according to the fifth embodiment. After the process of step S12 and step S14 is ended, the judgment part 2072 judges whether the initial phase difference acquisition instruction was issued from the phase acquisition part 2076 to the scale sensor 44 (step S42). The initial phase difference acquisition instruction is done by the phase acquisition part 2076 sending the initial phase difference instruction signal to the scale sensor 44.

If the judgment part 2072 judges that the initial phase difference acquisition instruction is not issued (NO of step S42), the process is ended.

On the other hand, if the judgment part 2072 judges that the initial phase difference acquisition instruction was performed (YES of step S42), the process proceeds to step S16. According to the process of step S16 and step S22, establishment of a condition where the scale sensor 44 can detect the belt scale 25 is delayed (YES of step S16), and the process proceeds to step S44.

In step S44, the judgment part 2072 judges whether the position signal from the edge sensor 19 is sufficiently stable. Specifically, the judgment whether the position signal is sufficiently stable is a determination whether the position signal is a constant value or near the constant value during a predetermined time T5. Accordingly, the predetermined time T5 is previously set to a time period sufficient for the position signal reaching a constant value or a value close to the constant value. The constant value may be a value (X+X1) obtained by adding a predetermined value X1 to the reference value X(V). Additionally, a value close to the constant value (X+X1) means a value which is not completely equal to the constant value but slightly larger or slightly smaller than the constant value (x+X1).

If the judgment part 2072 judges that the position signal is not sufficiently stable (NO of step S44), the process proceeds to step S22. On the other hand, if the judgment part 2072 judges that the position signal is sufficiently stable (YES of step S44), the process proceeds to step S46. In step S46, the initial phase difference acquisition process is performed. When the position signal from the edge sensor 19 reaches the constant value or a value close to the constant value, the scale sensor 44 can acquire an accurate initial phase difference. Thus, by providing the process of step S44, the judgment of generation of an abnormality in the initial phase difference acquisition process can be made surely.

The process of step S44 can be applied to the processes in the first through fourth embodiments. In such a case, the process of step 44 may be performed after the process of step S16 is ended.

As mentioned above, in the belt drive apparatus according to the fifth embodiment, after the condition is established where the scale sensor 44 can detect the belt scale 25 (YES of step S16), the initial phase difference is acquired based on the output of the scale sensor 44. Accordingly, an accurate initial phase difference can be acquired.

A description will be given below of a sixth embodiment of the present invention. In the sixth embodiment, a notification of an abnormality in the initial phase difference acquisition process of the belt drive apparatus is made.

When the initial phase difference acquisition process is performed immediately after the light amount adjustment execution instruction is issued, if a judgment is made that there is an abnormality in the initial phase difference acquisition process, a notification of the abnormality is made. Accordingly, if the scale sensor 44 is located at a position where the scale sensor 44 cannot detect the belt scale 25, it is difficult to acquire the initial phase difference from the outputs of the sensors 44A and 44B of the scale sensor 44 within a predetermined time after the start of driving the intermediate transfer belt 1. Thus, it is possible that an erroneous judgment is made that there is an abnormality in the initial phase difference acquisition process although there is no abnormality in the scale sensor 44 and the belt scale 25.

Accordingly, the belt drive apparatus according to the present embodiment accurately performs a notification of an abnormality in the initial phase difference acquisition process by performing a control process mentioned below.

Figure 13B:
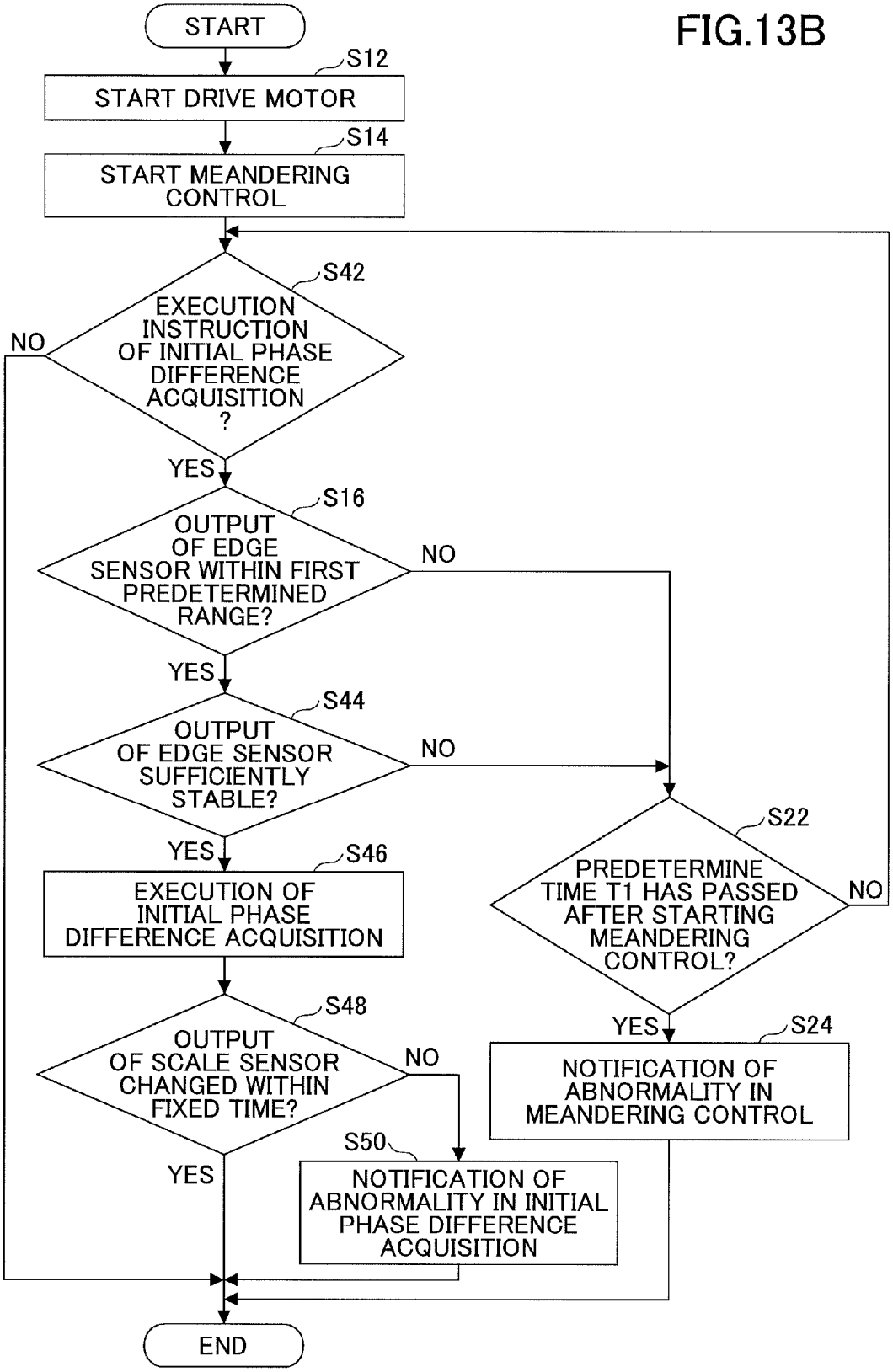
FIG. 13B is a flowchart of a control process of a belt drive apparatus according to a sixth embodiment.

FIG. 13B is a flowchart of a control process of a belt drive apparatus according to the sixth embodiment. After the phase difference acquisition process is started in step S46, the judgment part 2072 judges whether there is an abnormality in the phase difference acquisition process. Specifically, the judgment part 2072 judges whether the output signal from the scale sensor 44 has changed within a predetermined time T4 which was set previously (step S48). The output signal from the scale sensor is the maximum amplitude (refer to FIG. 8C) of the analog signal output from the sensors 44A and/or 44B of the scale sensor 44. The predetermined time T4 is set to a time period sufficient for the output signal from the scale sensor 44 being changed.

If it is judged in step S48 that the signal from the scale sensor 44 has changed within the predetermined time T4 (YES of step S48), the process is ended. On the other hand, if it is judged in step S48 that the output signal from the scale sensor 44 has not changed within the predetermined time T4 (NO of step S48), the abnormality notification part 2066 sends a notification that an abnormality occurs in the initial phase difference acquisition process (step S50). The abnormality in the initial phase difference acquisition process includes an abnormality in a function to acquire the initial phase difference from the output of the scale sensor 44, an abnormality in the phase acquisition part 2076 of the control part 206, etc.

According to the above-mentioned sixth embodiment, the judgment of an abnormality in the initial phase difference acquisition process is done after the intermediate transfer belt 1 moves to a position where the scale sensor 44 can detect the belt scale 25. Accordingly, no erroneous notification is sent that "there is an abnormality in the initial phase difference acquisition process" because of the reason that the scale sensor 44 cannot detect the belt scale 25, although there is no abnormality in the function of acquiring the initial phase difference from the output signal of the scale sensor and the initial phase difference acquisition process in the phase acquisition part 2076. As a result, an accurate notification of abnormality can be sent with respect to the initial phase difference acquisition process.

In addition, the elongation/contraction correction part 2070 eliminates influences of an elongation/contraction of the intermediate transfer belt 1 using the initial phase difference acquired by the initial phase difference acquisition process.

A description is given below of a seventh embodiment of the present invention.

In the above-mentioned embodiments, descriptions were given of the feedback process (first embodiment), the abnormality notification of the feedback process (second embodiment), the light amount adjustment process (third embodiment), the abnormality notification of the light amount adjustment process (fourth embodiment), the initial phase difference acquisition process (fifth embodiment), and the abnormality notification of the initial phase difference acquisition process (sixth embodiment). Two or more of the aforementioned embodiments may be combined.

For example, a seventh embodiment of the present invention combines the abnormality notification of the light amount adjustment process and the abnormality notification of the initial phase difference acquisition process. That is, a belt drive apparatus according to the seventh embodiment of the present invention can perform both the abnormality notification of the light amount adjustment process and the abnormality notification of the initial phase difference acquisition process.

Figure 14A:
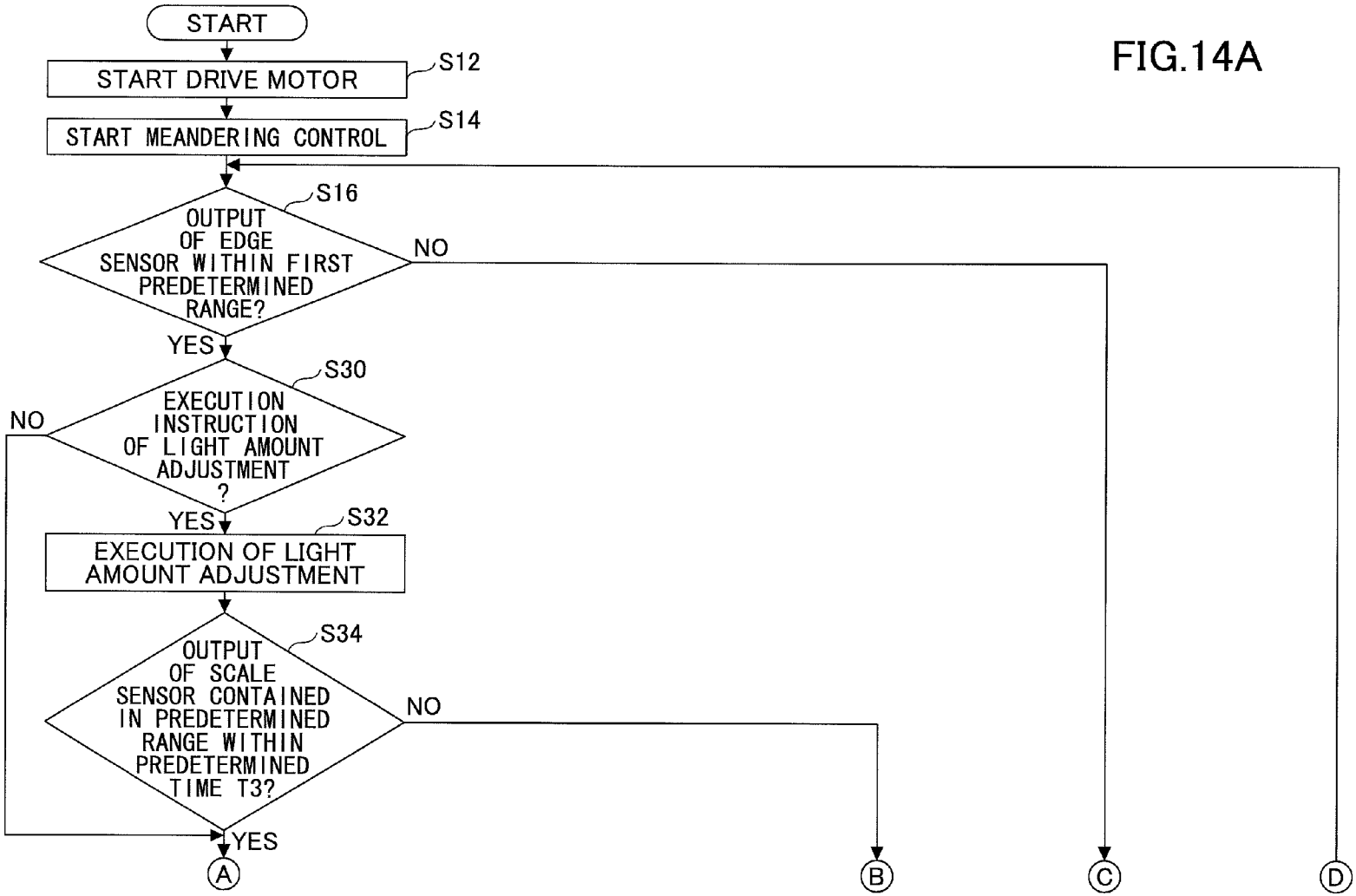
FIGS. 14A and 14B are parts of a flowchart of a control process of a belt drive apparatus according to a seventh embodiment.
Figure 14B:
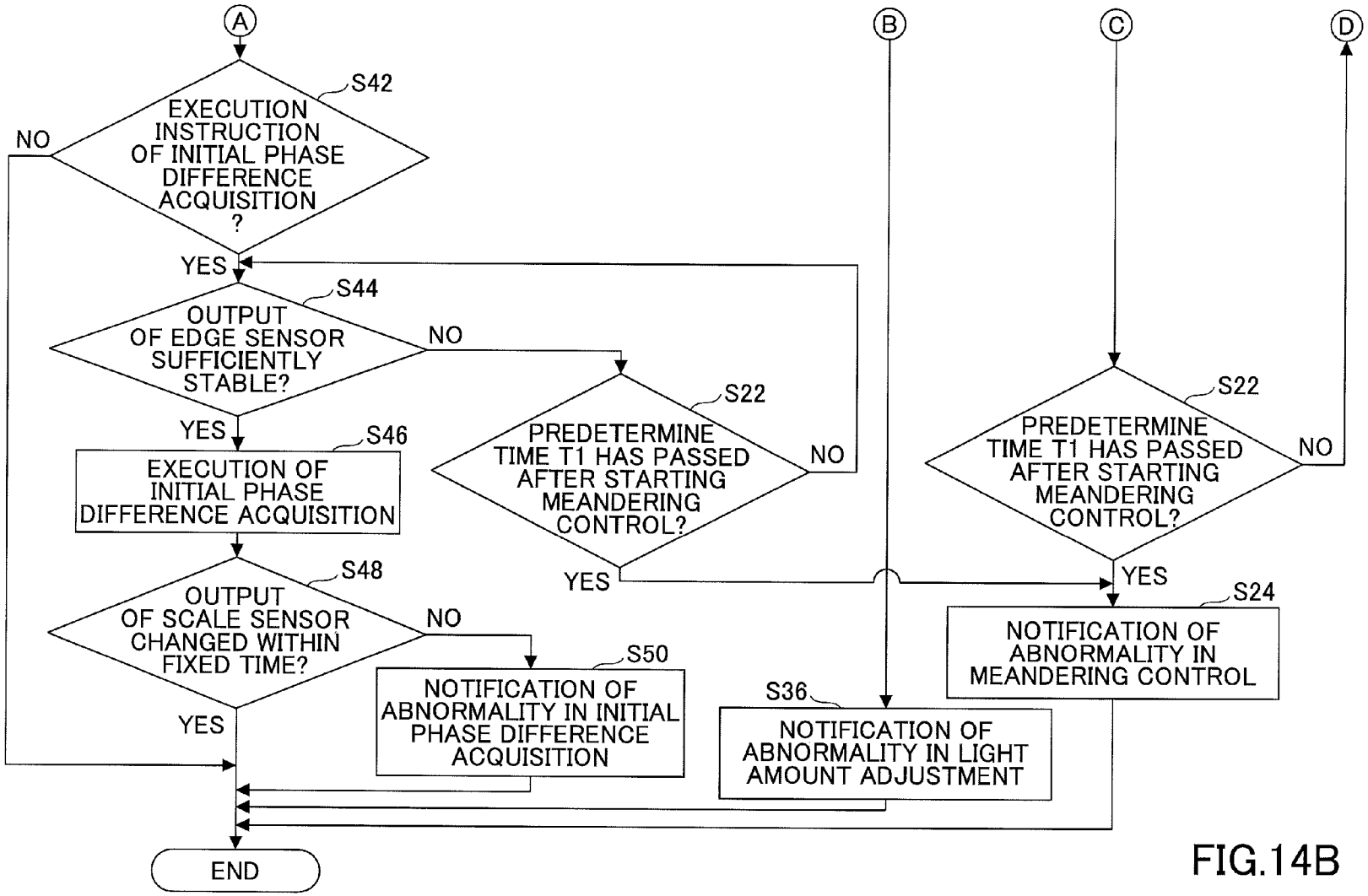

FIGS. 14A and 14B are parts of a flowchart of a control process of the belt drive apparatus according to the seventh embodiment. FIG. 14A illustrates a first half of the control process, and FIG. 14B illustrates a second half of the control process. The signs A through D in FIG. 14A indicate connection to the corresponding signs A through D in FIG. 14B.

After the process of step S12 and step S14 is ended, it is determined in step S14 whether the position signal from the edge sensor 19 falls within the first predetermined range. After the process of step S16 is ended, the abnormality notification process of the light amount adjustment process is performed in step S30, step S32, step S34 and step S36. Thereafter, the abnormality notification process of the initial phase difference acquisition process is performed in step S42, step S44, step S46, step S48 and step S50. In the process of step S42, step S44, step S46, step S48, and step S50, unusual notice processing of initial phase difference acquisition processing is performed after that.

Although the abnormality notification of the light amount adjustment process and the abnormality notification of the initial phase difference acquisition process are performed in that order in the process illustrated in FIGS. 14A and 14B, the order of performing the abnormality notification processes may be reversed.

Figure 15:
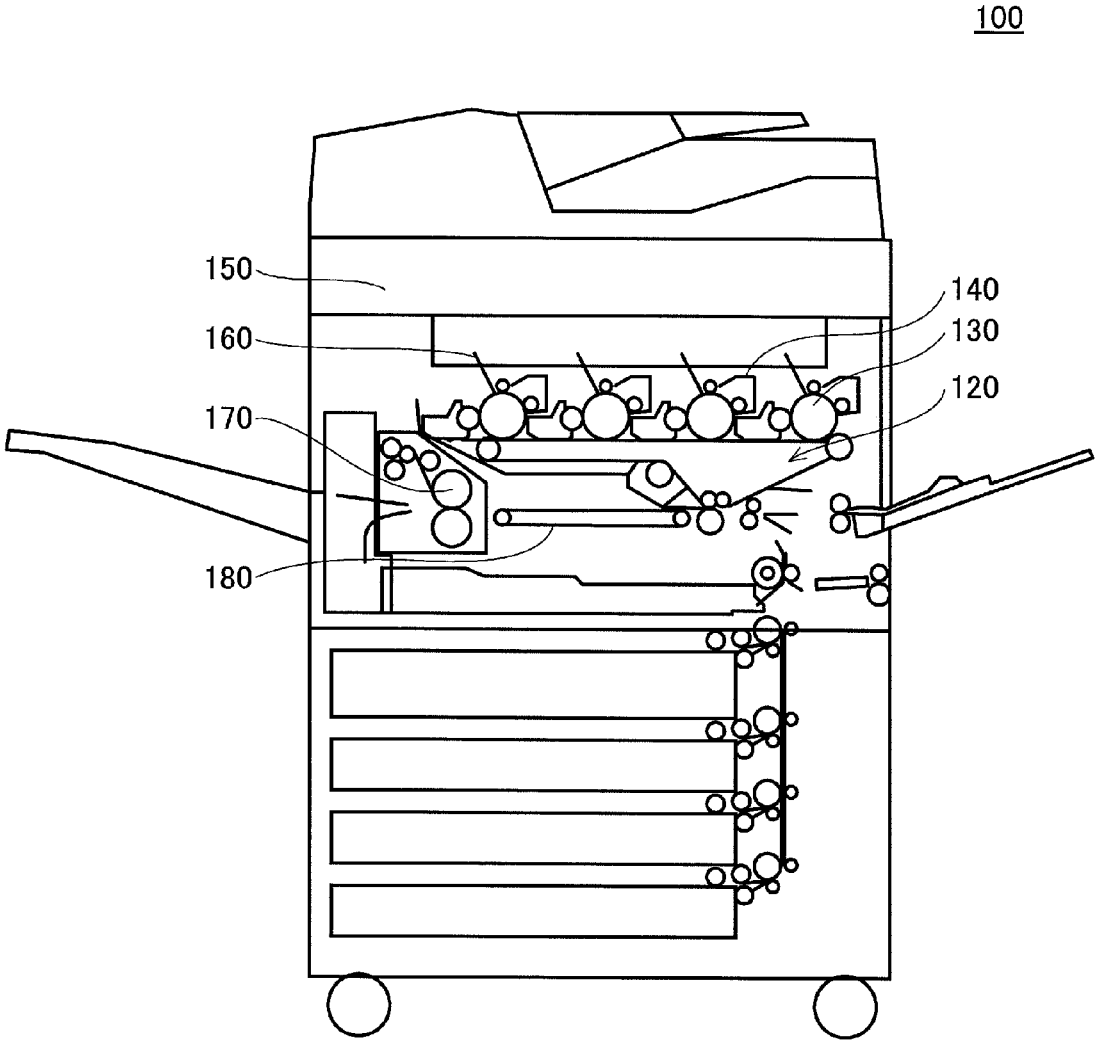
FIG. 15 is an illustration of an outline structure of a color copy machine according to an embodiment of the present invention.

The belt drive apparatuses according to the above-mentioned first through seventh embodiment can be used as a belt drive apparatus provided in the image forming part (refer to FIGS. 3 and 4) of a color copy machine, which is an example of an image forming apparatus. FIG. 15 is an illustration of an outline structure of a color copy machine according to an embodiment of the present invention. In the color copy machine 100, a scanner part 150 reads an original document by irradiating a scanning light onto the original document and receiving a reflected light from the original document by a 3-line CCD sensor. Image data obtained by reading the original document is subjected to a scanner γ correction process, a color conversion process, an image separation process, a gradation correction process, etc., in an image processing unit. The processed image data is sent to an image writing unit 160. The image writing unit 160 generates a laser beam by a laser diode (LD) and modulates the laser beam according to the image data. A photoconductor unit 130 projects the laser beam onto a uniformly charged surface of a photoconductor drum to form a latent image on the uniformly charged surface. A development unit 140 develops the latent image by supplying a toner to the photoconductor drum. A toner image formed on the photoconductor drum is transferred onto a transfer belt of a primary transfer unit of a paper transfer part 120. In a case of a full-color copy, toner images of four colors (black (Bk), cyan (C), magenta (M), yellow (Y)) are formed on four conductive drums, respectively, and the four color toner images are sequentially transferred to the primary transfer belt one on another to form a full-color toner image. After the full-color toner image is formed, a transfer paper is fed from a paper supply part in synchronization with the primary transfer belt. Then, the paper transfer part 120 transfers the full-color toner image from the primary transfer belt to the transfer paper. The transfer paper having the full-color toner image thereon is conveyed to the fixing part 170 through a conveyance part 180. The fixing part 170 fixes the full-color toner image on the transfer paper by heating. Then, the transfer paper is ejected onto a paper eject tray.

Although the above-mentioned color copy machine 100 is an image forming apparatus of an indirect transfer type, the present invention may be applied to an image forming apparatus of a direct transfer type.

The present invention is not limited to the specifically disclosed embodiments, and variations and modifications may be made without departing from the scope of the present invention.

The present application is based on Japanese priority applications No. 2010-063198 filed on Mar. 18, 2010 and No. 2011-032015 filed on Feb. 17, 2011, the entire contents of which are incorporated herein by reference.

What is claimed is:

1. A belt drive apparatus, comprising:

an endless belt rotationally movable by being supported by a plurality of rollers;

a moving speed signal output part configured to output a signal based on a rotational movement of said endless belt;

a width direction position signal output part configured to output a position signal for which its value changes in response to a position of said endless belt in a direction of width of said endless belt;

a width direction position control part configured to control a position of said endless belt in the direction of width of said endless belt;

a process execution part configured to perform a predetermined process using said signal output from said moving speed output part based on said position signal output from said width direction position signal output part;

a judgment part configured to judge whether said position signal from said width direction position signal output part falls within a predetermined range within a predetermined time from a start of the control of said width direction position control part, and subsequently judge whether an abnormality occurs in said predetermined process after the judgment part judges that said position signal falls within the predetermined range within the predetermined time, and an abnormality notification part configured to notify that there is an abnormality when said judgment part judges that said position signal does not fall within the predetermined range within the predetermined time.

2. The belt drive apparatus as claimed in claim 1, wherein said predetermined process includes a feedback control of a rotational moving speed of said endless belt.

3. The belt drive apparatus as claimed in claim 1, wherein said moving speed signal output part includes an optical sensor, and said predetermined process includes a light amount adjustment process of said optical sensor.

4. The belt drive apparatus as claimed in claim 1, wherein said predetermined process includes a phase difference acquisition process to acquire a phase difference from the signal of said moving speed signal output part.

5. The belt drive apparatus as claimed in claim 4, wherein said process execution part starts said predetermined process when the signal from said width direction position signal output part falls within the predetermined range within the predetermined time and when the signal from said width direction position signal output part is equal to a constant value or a value close to the constant value.

6. The belt drive apparatus as claimed in claim 1, further comprising a judgment part configured to judge that an abnormality occurs in the control of a position of said endless belt in the direction of the width of said endless belt performed by said width direction position control part when the position signal from said width direction position signal output part does not fall within the predetermined range within the predetermined time from a start of the control of said width direction position control part.

7. An image forming apparatus, comprising:

the belt drive apparatus as claimed in claim 1; and an image forming part configured to form a visible image on said endless belt of said belt drive apparatus.

8. The belt drive apparatus as claimed in claim 1, wherein the judgment part subsequently judges whether the abnormality occurs in said predetermined process only after the judgment part judges that said position signal falls within the predetermined range within the predetermined time from the start of the control of said width direction position control part.

9. A belt drive method, comprising:

outputting a signal based on a rotational movement of an endless belt, which rotationally moves while being supported by a plurality of rollers;

outputting a position signal for which its value changes in response to a position of said endless belt in a direction of width of said endless belt;

controlling the position of said endless belt in the direction of width of said endless belt;

performing a predetermined process using said signal based on a rotational movement of said endless belt based on said position signal, judging whether said position signal from said width direction position signal output part falls within a predetermined range within a predetermined time from a start of the control of said width direction position control part, and subsequently judging whether an abnormality occurs in said predetermined process after the judging step judges that said position signal falls within the predetermined range within the predetermined time, and notifying that there is an abnormality when said judgment steps judges that said position signal does not fall within the predetermined range within the predetermined time.

* * * * *